US009725099B2

(12) United States Patent
Gallagher et al.

(10) Patent No.: US 9,725,099 B2
(45) Date of Patent: Aug. 8, 2017

(54) METHOD AND SYSTEM FOR REGENERATION IN A VEHICLE IN A CONSIST

(71) Applicant: General Electric Company, Schenectady, NY (US)

(72) Inventors: Shawn Michael Gallagher, Lawrence Park, PA (US); Eric David Peters, Lawrence Park, PA (US)

(73) Assignee: General Electric Company, Schenectady, NY (US)

( * ) Notice: Subject to any disclaimer, the term of this patent is extended or adjusted under 35 U.S.C. 154(b) by 499 days.

(21) Appl. No.: 14/500,034

(22) Filed: Sep. 29, 2014

(65) Prior Publication Data

US 2015/0013312 A1 Jan. 15, 2015

Related U.S. Application Data

(63) Continuation-in-part of application No. 13/213,236, filed on Aug. 19, 2011, now Pat. No. 8,868,266.

(51) Int. Cl.
*F01N 3/00* (2006.01)
*B61C 5/00* (2006.01)
(Continued)

(52) U.S. Cl.
CPC ..... *B61C 5/00* (2013.01); *B61C 17/12* (2013.01); *F02D 41/029* (2013.01);
(Continued)

(58) Field of Classification Search
CPC .... F02D 41/029; F02D 41/1448; F02D 29/02; F02D 25/00; F02D 2200/06;
(Continued)

(56) References Cited

U.S. PATENT DOCUMENTS 4,945,722 A 8/1990 Goerlich
6,304,815 B1 10/2001 Moraal et al.
(Continued)

FOREIGN PATENT DOCUMENTS

DE 102007015875 A1 10/2008
FR 2892465 A1 4/2007
(Continued)

OTHER PUBLICATIONS

Gallagher, Shawn Michael et al., "System and Method for Regenerating A Particulate Filter," U.S. Appl. No. 13/186,595, filed Jul. 20, 2011, 48 pages.
(Continued)

*Primary Examiner* — Mark Laurenzi
*Assistant Examiner* — Kelsey Stanek
(74) *Attorney, Agent, or Firm* — Global Patent Operation; John A. Kramer

(57) ABSTRACT

Methods and systems for distributing engine output among vehicles of a consist are disclosed. One example system comprises a controller including non-transitory media having instructions stored on the media and executed by the controller for adjusting distribution of engine output between at least a first engine and a second engine in response to a regeneration mode, wherein the regeneration mode regenerates an exhaust gas recirculation (EGR) cooler that is coupled to the first engine.

20 Claims, 10 Drawing Sheets

(51) Int. Cl.

| | |
|---|---|
| ***B61C 17/12*** | (2006.01) |
| ***F02D 41/02*** | (2006.01) |
| ***F02M 25/08*** | (2006.01) |
| *F02D 41/14* | (2006.01) |

(52) U.S. Cl.
CPC ..... *F02M 25/0818* (2013.01); *F02D 41/1448* (2013.01); *F02D 2200/06* (2013.01); *F02D 2200/0802* (2013.01); *F02D 2200/0812* (2013.01); *F02D 2200/50* (2013.01); *F02D 2200/602* (2013.01); *F02D 2200/604* (2013.01); *F02D 2200/702* (2013.01); *F02D 2250/18* (2013.01)

(58) Field of Classification Search
CPC ..... F02D 2200/0812; F02D 2200/50; F02D 2200/602; F02D 2200/604; F02D 2200/702; F02D 2200/0802; F02D 2250/18; B61C 5/00; B61C 5/04; B61C 17/00; B61C 17/12; F01N 9/002; F02M 25/0818
USPC ..... 60/274, 295; 701/19
See application file for complete search history.

(56) References Cited

U.S. PATENT DOCUMENTS

| | | | |
|---|---|---|---|
| 6,691,957 | B2 | 2/2004 | Hess, Jr. et al. |
| 6,694,725 | B2 | 2/2004 | Furman et al. |
| 6,763,291 | B1 | 7/2004 | Houpt et al. |
| 7,021,588 | B2 | 4/2006 | Hess, Jr. et al. |
| 7,021,589 | B2 | 4/2006 | Hess, Jr. et al. |
| 7,618,011 | B2 | 11/2009 | Oleski et al. |
| 7,925,431 | B2 | 4/2011 | Gallagher et al. |
| 2006/0096280 | A1 | 5/2006 | Zhan et al. |
| 2007/0219683 | A1 | 9/2007 | Daum et al. |
| 2008/0082223 | A1 | 4/2008 | Daum et al. |
| 2008/0125924 | A1 | 5/2008 | Daum et al. |
| 2008/0201019 | A1 | 8/2008 | Kumar et al. |
| 2009/0044515 | A1 | 2/2009 | Lu et al. |
| 2009/0044531 | A1 | 2/2009 | Lu et al. |
| 2009/0299560 | A1 | 12/2009 | Tomatsuri et al. |
| 2010/0023190 | A1 | 1/2010 | Kumar et al. |
| 2010/0031638 | A1 | 2/2010 | Sheidler |
| 2011/0072799 | A1 | 3/2011 | Bidner et al. |
| 2011/0283682 | A1 | 11/2011 | Gallagher et al. |

FOREIGN PATENT DOCUMENTS

| | | | |
|---|---|---|---|
| WO | 2008119589 | A1 | 10/2008 |
| WO | 2009023474 | A1 | 2/2009 |
| WO | 2009099771 | A1 | 8/2009 |

OTHER PUBLICATIONS

ISA European Patent Office, International Search Report and Written Opinion in International Application No. PCT/US2012/050340, Feb. 1, 2013, WIPO, 11 pages.

METHOD AND SYSTEM FOR REGENERATION IN A VEHICLE IN A CONSIST

CROSS REFERENCE TO RELATED APPLICATIONS

This application is a continuation-in-part of U.S. application Ser. No. 13/213,236, filed Aug. 19, 2011, and titled METHOD AND SYSTEM FOR ENGINE EXHAUST FILTER REGENERATION OF A VEHICLE IN A CONSIST, which is hereby incorporated by reference in its entirety for all purposes.

FIELD

Embodiments of the subject matter herein relate to methods and systems for regenerating an exhaust gas recirculation cooler in an engine exhaust.

BACKGROUND

Internal combustion engines may utilize a particulate filter in the exhaust to reduce the amount of emitted particulate matter. The particulate filter traps particulate matter, for example on a porous substrate through which the exhaust gasses flow. Once a particulate filter reaches its soot load capacity, back pressure to the engine may increase, decreasing fuel economy. Further, excess particulates may be released to the atmosphere, degrading emissions.

Under relatively high engine loads, exhaust temperature may be high enough to commence and sustain regeneration of the filter, during which soot accumulated on the filter burns and is thereby removed. Under relatively low engine loads, exhaust temperature may not be high enough to commence or sustain regeneration. In this case, various mechanisms may be used to increase exhaust heat and thus raise exhaust temperature sufficient for regeneration. However, the excess heat is frequently provided by mechanisms that utilize fuel without creating useful power for the engine, such as electric heaters or fuel injected to the exhaust, thereby decreasing fuel economy. As such, timing of the filter regeneration may be scheduled based on an expected route and engine load settings in order to regenerate the filter in a way that reduces wasted fuel.

Nevertheless, due to modeling errors and variation in operating conditions that affect the actual soot loading, it can be difficult to properly plan filter regeneration according to a planned engine load setting over a trip. In particular, small variations in actual soot loading over relatively long engine operation (such as cross country trips) quickly render such planning ineffective.

Engine systems may further include exhaust gas recirculation (EGR), where a portion of the engine exhaust is recirculated back to the intake manifold and inducted to the cylinders of the engine, in order to reduce combustion temperatures and lower NOx production. Some EGR systems include one or more EGR devices, such as coolers or mixers, to reduce the temperature of the exhaust to a desired temperature and/or effectively mix the EGR with intake air. Similar to the particulate filters described above, these EGR devices may also trap particulates and become ineffective if a soot load on the EGR device reaches a threshold. To regenerate an EGR device, exhaust temperature may be increased to burn the particulate matter, for example. Such EGR device regeneration suffers from the same issues described above for particulate filters, including wasted energy used to perform the regeneration and/or difficulty in planning an appropriate time for regeneration.

BRIEF DESCRIPTION

In one embodiment, a system comprises a controller including non-transitory media having instructions stored on the media and executed by the controller for adjusting distribution of engine output between at least a first engine and a second engine in response to a regeneration mode, wherein the regeneration mode regenerates an exhaust gas recirculation (EGR) cooler that is coupled to the first engine.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
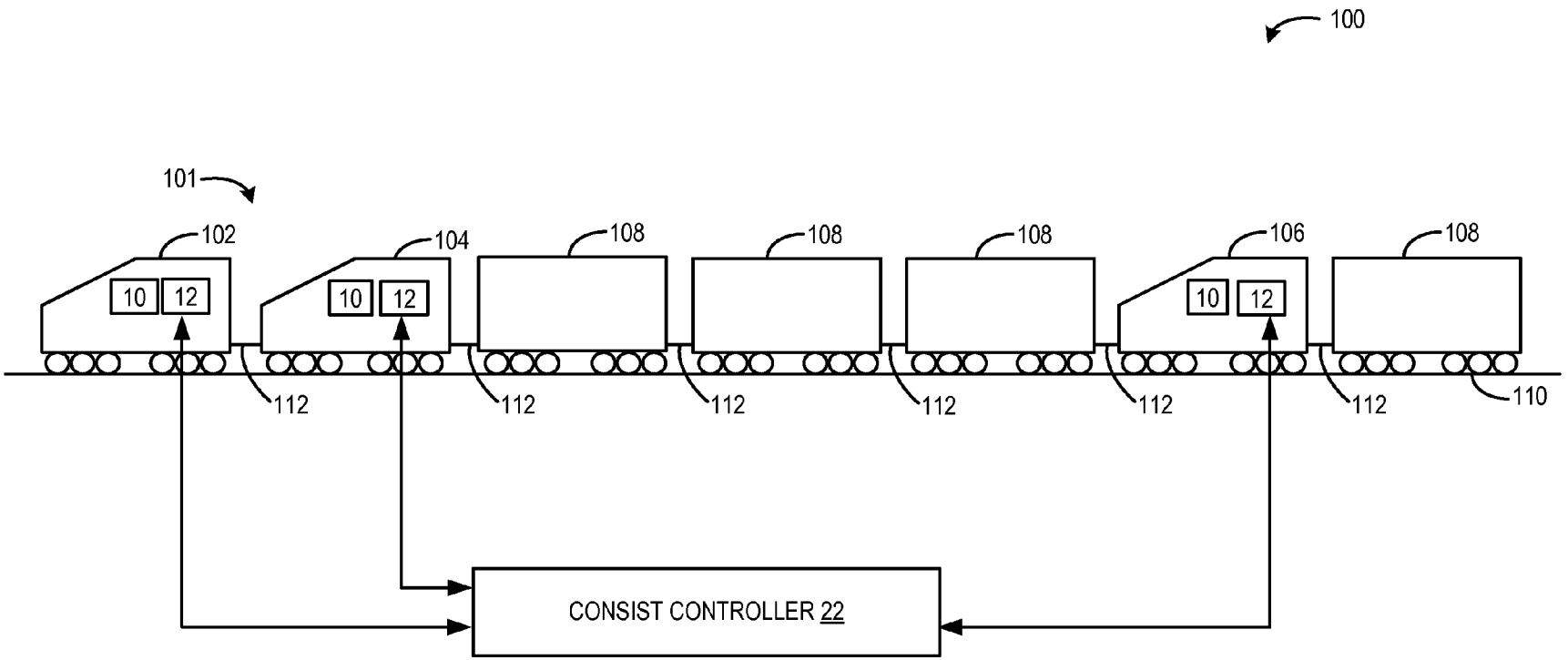
FIG. 1 shows an embodiment of a consist including a plurality of vehicles.
Figure 2:
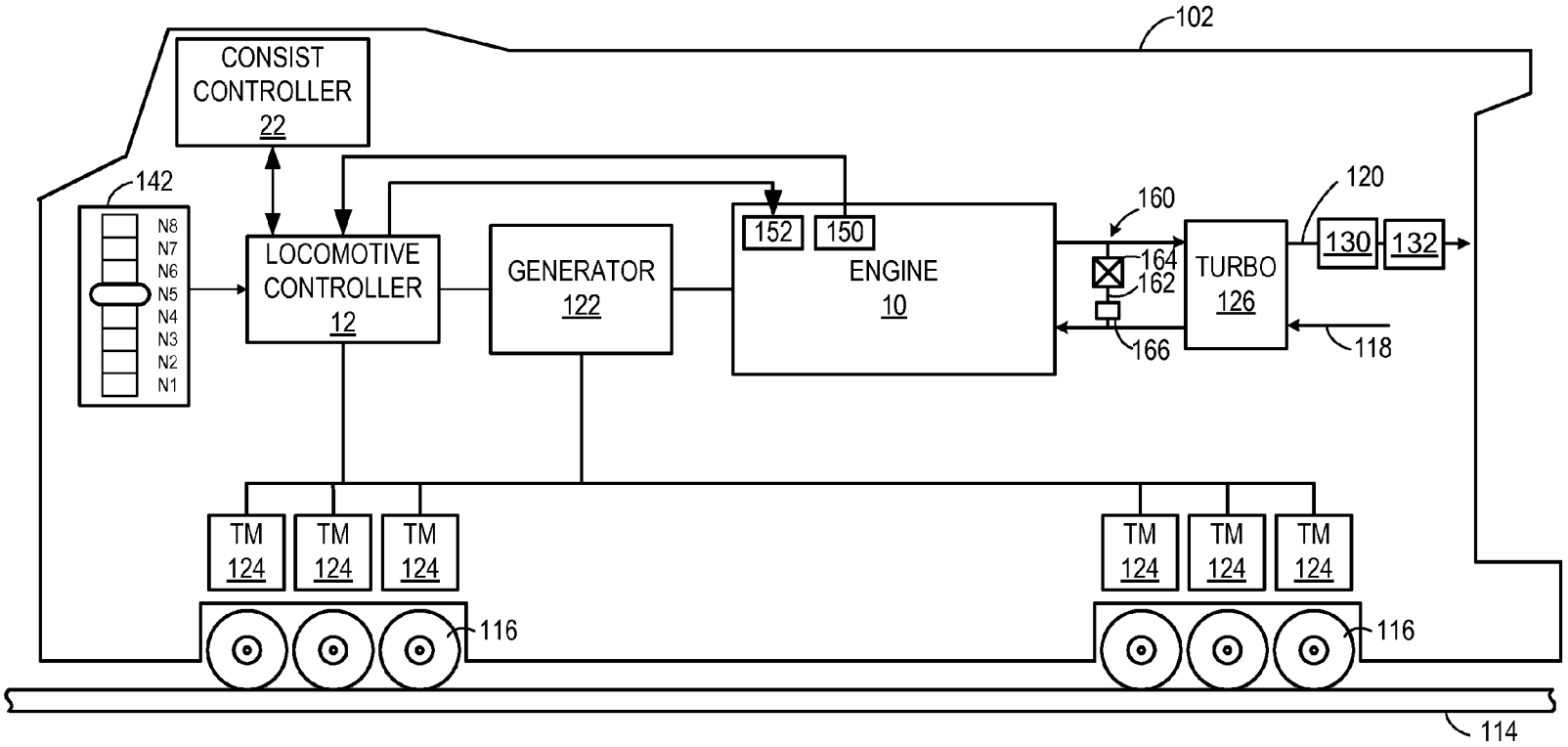
FIG. 2 shows a schematic diagram of an embodiment of a vehicle from FIG. 1 with a diesel particulate filter and EGR cooler.

In one embodiment, a method is described for controlling operation of a consist including a plurality of engine-powered vehicles. One or more of the engines may include a particulate filter in the engine exhaust. If the consist is operating with an engine load distribution such that a temperature of the particulate filter is lower than needed to commence or sustain filter regeneration when needed, the engine load distribution among the consist may be temporarily adjusted from current settings. This adjustment enables the engine coupled to the filter to operate at a higher load, and thus higher exhaust temperature, to aid filter regeneration. Similarly, one or more remaining engines in the consist is adjusted to operate at a lower load, to thereby maintain overall vehicle travel. In another embodiment, a system is described for controlling operation of a consist including a plurality of engine-powered vehicles. One or more of the engines may include an exhaust gas recirculation (EGR) device in the engine exhaust. If the consist is operating with an engine load distribution such that a temperature of the EGR device is lower (or higher) than needed to commence or sustain EGR device regeneration when needed, the engine load distribution among the consist may be temporarily adjusted from current settings. This adjustment enables the engine coupled to the EGR device to operate at a higher (or lower) load, and thus higher (or lower) exhaust temperature, to aid EGR device regeneration. Similarly, one or more remaining engines in the consist is adjusted to operate at a lower (or higher) load, to thereby maintain overall vehicle travel. FIG. 1 depicts an example vehicle consist. FIG. 2 describes additional details of an example engine-powered vehicle in the consist. FIGS. 3-10 describe various methods of operation that may be carried out in the consist.

FIG. 1 depicts an example train 100, including a plurality of rail vehicles 102, 104, 106, and a plurality of cars 108, configured to run on track 110. The plurality of vehicles 102, 104, 106 may be locomotives, including a lead locomotive 102 and one or more remote locomotives 104, 106. While the depicted example shows three locomotives and four cars, any appropriate number of locomotives and cars may be included in train 100. Further, one or more vehicles in train 100 may comprise a consist. For example, in the embodiment depicted, locomotives 102, 104, 106 may comprise consist 101. In some embodiments, a consist may include only directly connected locomotives, and as such locomotive 106 may not be included in the consist. As illustrated, train 100 includes one consist. However, any appropriate number and arrangement of consists is within the scope of this disclosure.

Vehicles 102, 104, 106 are powered by engine 10, while cars 108 may be non-powered. In one example, each of vehicles 102, 104, 106 may include a diesel-electric drivetrain powered by a diesel engine. However, in alternate embodiments, the vehicles may be powered with an alternate engine configuration, such as a gasoline engine, a biodiesel engine, a natural gas engine, or wayside (e.g., catenary, or third-rail) electric, for example.

Vehicles 102, 104, 106 and cars 108 are coupled to each other through couplers 112. While the depicted example illustrates vehicles 104 and 106 connected to each other through interspersed cars 108, in alternate embodiments, vehicles 102, 104, and 106 may be connected in succession while the one or more cars 108 may be coupled thereafter.

Train 100 may further comprise a control system including at least one engine controller 12 and at least one consist controller 22. As depicted in FIG. 1, each vehicle includes one engine controller 12, all of which are in communication with the consist controller 22. The consist controller 22 may be located on one vehicle of the train, such as the lead locomotive, or may be remotely located, for example, at a dispatch center. The consist controller 22 is configured to receive information from, and transmit signals to, each of the locomotives of consist 101. For example, consist controller 22 may receive signals from a variety of sensors on train 100, and adjust train operations accordingly and is coupled to each engine controller 12 for adjusting engine operations of each locomotive. As elaborated with reference to FIGS. 3 and 4, each engine controller 12 of each vehicle may calculate a soot (or other particulate matter) load level for respective particulate filters included in the locomotives. Based on the soot (or other particulate matter) load levels, the consist controller 22 may then adjust engine load distribution across the vehicles to increase the exhaust temperature of a selected engine's exhaust in order to aid in particulate filter regeneration. Consist controller 22 and engine controller 12 will be discussed in more detail with respect to FIG. 2.

While FIG. 1 illustrates a vehicle consist in the form of a train, it is to be understood that other fleets of vehicles, mechanically and/or communicatively coupled, are within the scope of this disclosure. For example, a fleet of wireless automobiles may be configured to communicate with each other and/or a remote controller in order to carry out one or more of the methods described herein. In other example, a fleet of mine haul trucks on a set track may be configured to communicate with each other and/or a remote controller in order to carry out one or more of the methods described herein. In such examples, each automobile or mine haul vehicle may include an engine, particulate filter, EGR device, and controller, where the vehicle controller is communication with other vehicle controllers and/or a remote controller (e.g., the consist controller).

FIG. 2 depicts an example embodiment of a vehicle, such as a vehicle of train 100 from FIG. 1, herein depicted as a locomotive 102 including engine 10, configured to run on a rail 114 via a plurality of wheels 116. In one example, engine 10 may be a diesel engine. However, in alternate embodiments, alternate engine configurations may be employed, such as a gasoline engine, a biodiesel engine, a natural gas engine, or a gas turbine engine (turbojet, turbofan, turboprop, turboshaft), for example.

The engine 10 receives intake air for combustion from an intake passage 118. The intake passage 118 receives ambient air from an air filter (not shown) that filters air from outside of the locomotive 102. Exhaust gas resulting from combustion in the engine 10 is supplied to an exhaust passage 120. Exhaust gas flows through the exhaust passage 120, and out of an exhaust stack (not shown) of the locomotive 102.

In one embodiment, the locomotive 102 is a diesel-electric vehicle. As depicted in FIG. 2, the engine 10 is coupled to an electric power generation system, which includes an alternator/generator 122 and electric traction motors 124. For example, the engine 10 is a diesel engine that generates a torque output that is transmitted to the generator 122 which is mechanically coupled to the engine 10. The generator 122 produces electrical power that may be stored and applied for subsequent propagation to a variety of downstream electrical components. As an example, the generator 122 may be electrically coupled to a plurality of traction motors 124 and the generator 122 may provide electrical power to the plurality of traction motors 124. As depicted, the plurality of traction motors 124 are each connected to one of a plurality of wheels 116 to provide tractive power to propel the locomotive 102. One example locomotive configuration includes one traction motor per wheel. As depicted herein, six pairs of traction motors correspond to each of six pairs of wheels of the locomotive.

Locomotive 102 may further include a turbocharger 126 arranged between the intake passage 118 and the exhaust passage 120. The turbocharger 126 increases air charge of ambient air drawn into the intake passage 118 in order to provide greater charge density during combustion to increase power output and/or engine-operating efficiency. The turbocharger 126 may include a compressor (not shown) which is at least partially driven by a turbine (not shown). While in this case a single turbocharger is included, the system may include multiple turbine and/or compressor stages. Further, in some embodiments, a wastegate may be provided which allows exhaust gas to bypass the turbocharger 126. The wastegate may be opened, for example, to divert the exhaust gas flow away from the turbine. In this manner, the rotating speed of the compressor, and thus the boost provided by the turbocharger 126 to the engine 10 may be regulated.

The locomotive 102 further may include an exhaust gas recirculation (EGR) system 160, which routes exhaust gas from the exhaust passage 120 upstream of the turbocharger 126 to the intake passage downstream of the turbocharger 126. The EGR system 160 includes an EGR passage 162 and an EGR valve 164 for controlling an amount of exhaust gas that is recirculated from the exhaust passage 120 of engine 10 to the intake passage 118 of engine 10. By introducing exhaust gas to the engine 10, the amount of available oxygen for combustion is decreased, thereby reducing the combustion flame temperatures and reducing the formation of nitrogen oxides (e.g., NOx). The EGR valve 164 may be an on/off valve controlled by the engine controller 12, or it may control a variable amount of EGR, for example. The EGR system 160 may further include an EGR cooler 166 to reduce the temperature of the exhaust gas before it enters the intake passage 118. As the EGR cooler may be exposed to untreated exhaust gas, it can become plugged with particulates, reducing its effectiveness. Thus, it may utilize regeneration, as will be discussed with more detail in reference to FIG. 4, to remove soot (or other particulate matter) that may foul the cooler. As depicted in the non-limiting example embodiment of FIG. 2, the EGR system 160 is a high-pressure EGR system. In other embodiments, the locomotive 102 may additionally or alternatively include a low-pressure EGR system, routing EGR from a location downstream of the turbocharger to a location upstream of the turbocharger. Additionally, the EGR system may be a donor cylinder EGR system where one or more cylinders provide exhaust gas only to the EGR passage, and then to the intake.

The locomotive 102 includes an exhaust gas treatment system coupled in the exhaust passage to reduce regulated emissions. In one example embodiment, the exhaust gas treatment system may include a diesel oxidation catalyst (DOC) 130 and a diesel particulate filter (DPF) 132. The DPF 132 is configured to trap particulates, also known as particulate matter (an example of which is soot), produced during combustion, and may be comprised of ceramic, silicon carbide, or any suitable material. The DPF 132 may undergo regeneration once it has reached its soot (or other particulate matter) load capacity, as will be discussed in more detail with respect to FIG. 3.

In other embodiments, the exhaust gas treatment system may additionally include a selective catalytic reduction (SCR) catalyst, three-way catalyst, $NO_x$ trap, various other emission control devices or combinations thereof. In some embodiments, the exhaust gas treatment system may be positioned upstream of the turbocharger, while in other embodiments, the exhaust gas treatment system may be positioned downstream of the turbocharger.

Locomotive 102 may further include a throttle 142 coupled to engine 10 to indicate power levels. In this embodiment, the throttle 142 is depicted as a notch throttle. However, any suitable throttle is within the scope of this disclosure. Each notch of the notch throttle 142 may correspond to a discrete power level. The power level indicates an amount of load, or engine output, placed on the locomotive and controls the speed at which the locomotive will travel. Although eight notch settings are depicted in the example embodiment of FIG. 2, in other embodiments, the throttle notch may have more than eight notches or less than eight notches, as well as notches for idle and dynamic brake modes. In some embodiments, the notch setting may be selected by a human operator of the locomotive 102. In other embodiments, the consist controller 22 may determine a trip plan (e.g., a trip plan may be generated using trip optimization software, such as Trip Optimizer™ system available from General Electric Company and/or a load distribution plan may be generated using consist optimization software such as Consist Manager™ available from General Electric Company) including notch settings based on engine and/or locomotive operating conditions, as will be explained in more detail below.

As explained above with respect to FIG. 1, locomotive 102 further includes an engine controller 12 to control various components related to the locomotive 102. As an example, various components of the vehicle system may be coupled to the engine controller 12 via a communication channel or data bus. In one example, the engine controller 12 and the consist controller 22 each include a computer control system. The engine controller 12 and consist controller 22 may additionally or alternatively include a memory holding non-transitory computer readable storage media (not shown) including code for enabling on-board monitoring and control of locomotive operation. Engine controller 12 may be coupled to a consist controller 22, for example via a digital communication channel or data bus.

Both engine controller 12 and consist controller 22 may receive information from a plurality of sensors and may send control signals to a plurality of actuators. The engine controller 12, while overseeing control and management of the locomotive 102, may be configured to receive signals from a variety of engine sensors 150, as further elaborated herein, in order to determine operating parameters and operating conditions, and correspondingly adjust various engine actuators 152 to control operation of the locomotive 102. For example, the engine controller 12 may receive signals from various engine sensors 150 including, but not limited to, engine speed, engine load, intake manifold air pressure, boost pressure, exhaust pressure, ambient pressure, ambient temperature, exhaust temperature, particulate filter temperature, particulate filter back pressure, etc. Correspondingly, the engine controller 12 may control the locomotive 102 by sending commands to various components such as the traction motors 124, the alternator/generator 122, cylinder valves, fuel injectors, the notch throttle 142, etc. Other actuators may be coupled to various locations in the locomotive.

Consist controller 22 may comprise a communication portion operably coupled to a control signal portion. The communication portion may be configured to receive signals from locomotive sensors including locomotive position sensors (e.g., GPS device), environmental condition sensors (e.g., for sensing altitude, ambient humidity, temperature, and/or barometric pressure, or the like), locomotive coupler force sensors, a track grade sensors, locomotive notch sensors, brake position sensors, etc. Various other sensors may be coupled to various locations in the locomotive. The control signal portion may generate control signals to trigger various locomotive actuators. Example locomotive actuators may include air brakes, brake air compressor, traction motors, etc. Other actuators may be coupled to various locations in the locomotive. Consist controller 22 may receive inputs from the various locomotive sensors, process the data, and trigger the locomotive actuators in response to the processed input data based on instruction or code programmed therein corresponding to one or more routines. Further, consist controller 22 may receive engine data (as determined by the various engine sensors, such as particulate filter back pressure sensor and particulate filter temperature sensor) from engine controller 12, process the engine data, determine engine actuator settings, and transfer (e.g., download) instructions or code for triggering the engine actuators based on routines performed by the consist controller 22 back to engine controller 12.

For example, the consist controller 22 may determine a trip plan to distribute load among all vehicles in a fleet (e.g., locomotives in a train consist, fleet of wireless automobiles, mine haul trucks, etc.), based on operating conditions. In some conditions, the consist controller 22 may distribute the load unequally, that is, some vehicles may be operated at a higher power setting, or higher notch throttle setting, than other vehicles. The load distribution may be based on a plurality of factors, such as fuel economy, coupling forces, tunneling operating, grade, etc. In one example, the load distribution may be adapted during traveling from predetermined settings based on a particulate filter state, such as whether the filter loading is greater than a regeneration threshold. For example, the engine controller 12 may determine a soot (or other particulate matter) load of the DPF 132 within locomotive 102 is above capacity, and indicate to the consist controller 22 to reconfigure the trip plan to redistribute the load to provide additional power to the engine 10 coupled to the DPF 132 in order to initiate regeneration of the DPF.

Figure 3:
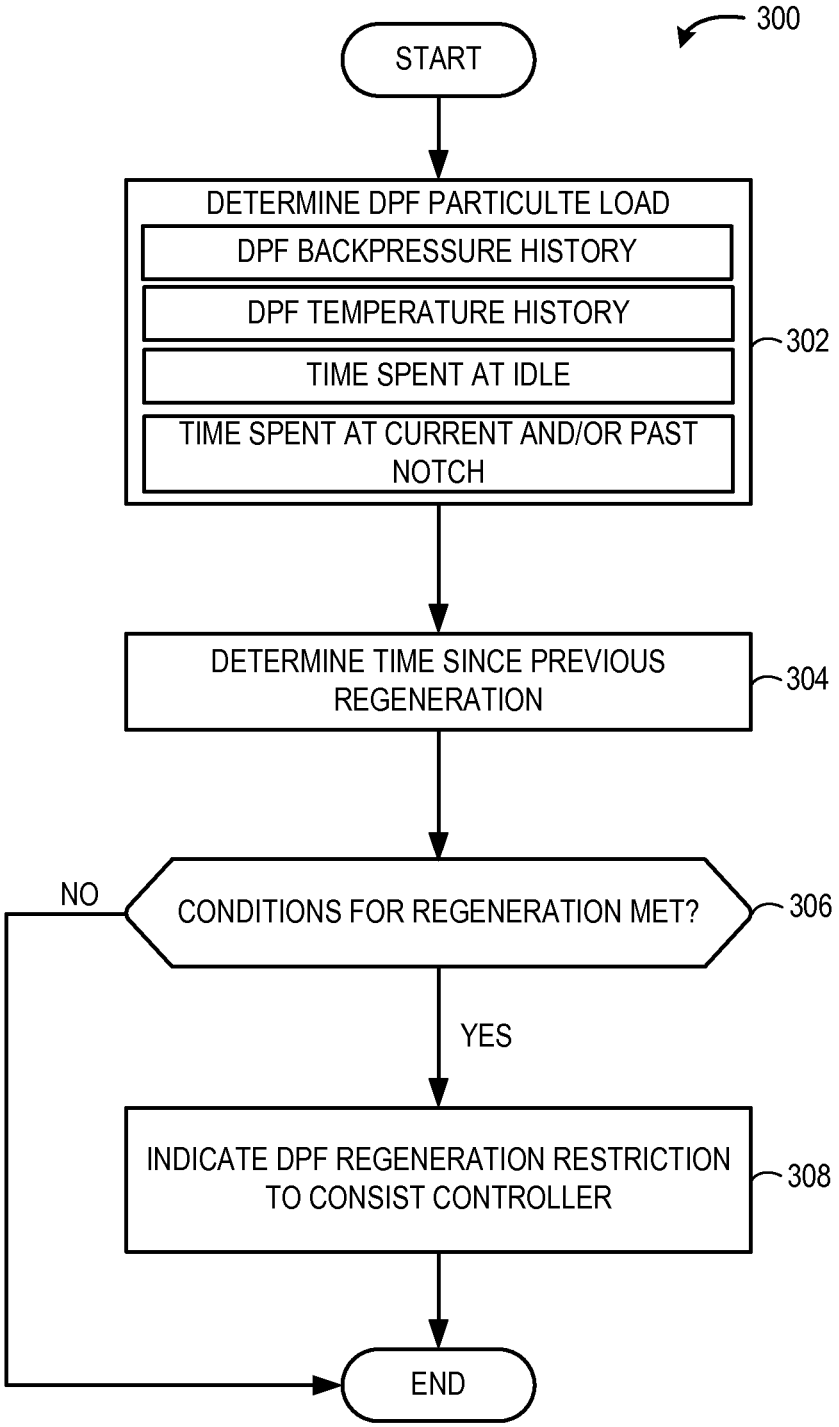
FIG. 3 is a flow diagram illustrating a method for determining a filter regeneration state according to one embodiment of the present disclosure.

Turning to FIG. 3, a routine 300 for indicating DPF regeneration is shown. Routine 300 may be carried out by each engine controller, such as engine controller 12, of each vehicle in a fleet, such as each locomotive in train 100. Routine 300 comprises, at 302, determining a particulate load level for a DPF. The particulate load level may be calculated based on a combination of sensor and operational data. For example, particulate load level may be calculated based on sensor data including DPF temperature history and DPF back pressure history, and on operational data including time spent at current and/or previous notch setting and time spent at idle. When a DPF reaches its capacity, particulates may clog the DPF such that exhaust cannot efficiently flow through the DPF. As a result, back pressure may increase. In addition, DPF particulate load may be partially estimated based on time spent at idle and current or past notch setting, as engine operating conditions influence the amount of particulate matter produced.

Method 300 further comprises, at 304, determining a time since a previous DPF regeneration was performed. The engine controller can then utilize the determined soot (or other particulate matter) load level and/or time since a previous regeneration to determine if the DPF should be regenerated at 306. For example, if the particulate load level determined at 302 is above a threshold, the DPF may require regeneration. Additionally, even if the particulate load level is not above the threshold, if a predetermined amount of time has elapsed since a previous regeneration, the DPF may require regeneration. If conditions for a DPF regeneration have been met at 306, method 306 advances to 308 to indicate a DPF regeneration restriction to a consist controller. As described below with regard to FIG. 5, the regeneration restriction affects the load distribution among the plurality of engine-powered vehicles in the consist. If conditions for a DPF regeneration have not been met at 306, routine 300 ends.

Figure 4:
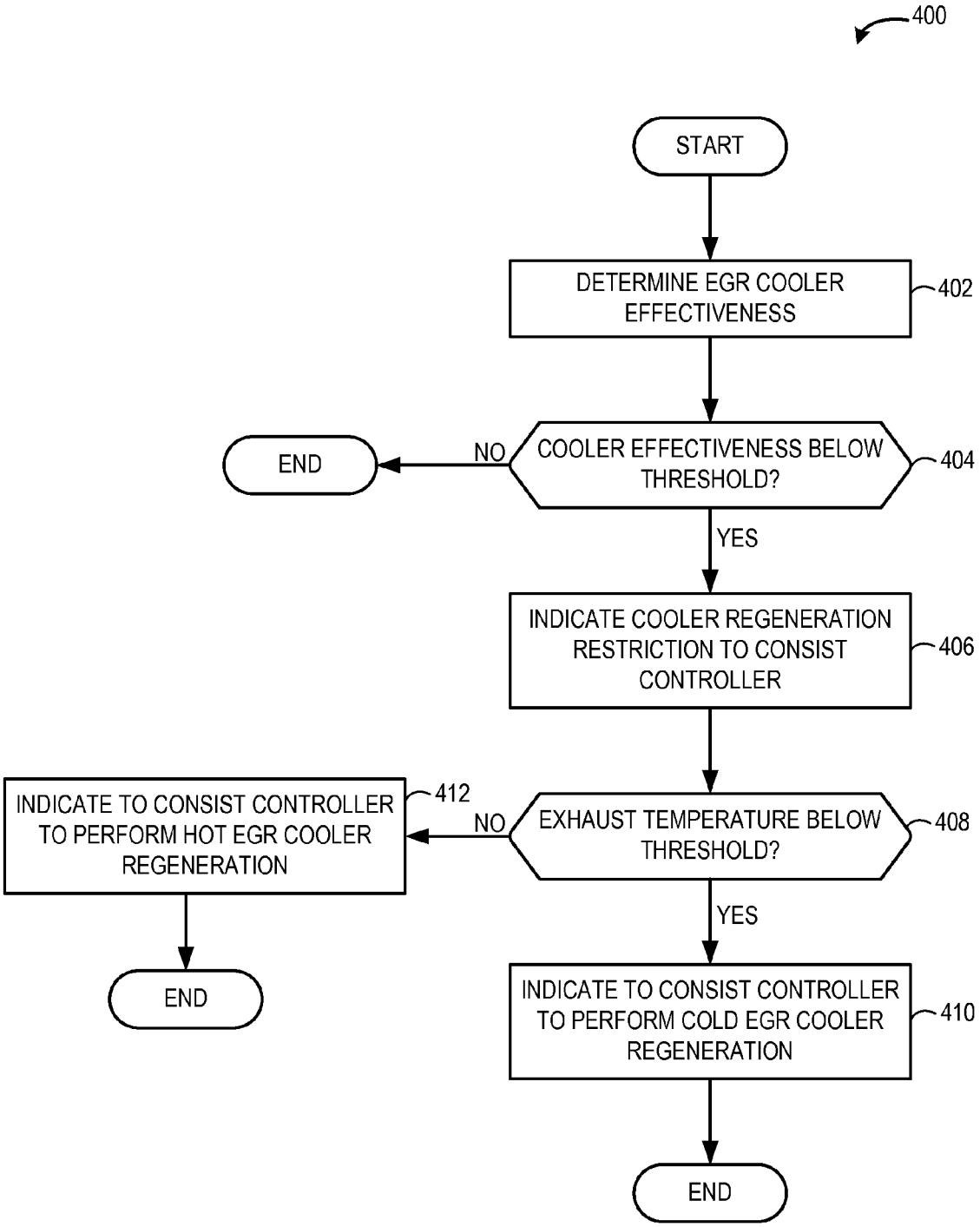
FIG. 4 is a flow diagram illustrating a method for determining an EGR cooler regeneration state according to one embodiment of the present disclosure.

Turning to FIG. 4, a routine 400 for indicating EGR cooler regeneration is shown. Routine 400 may be carried out by each engine controller, such as engine controller 12, of each vehicle in a fleet, such as each locomotive in train 100. Routine 400 comprises, at 402, determining EGR cooler effectiveness. EGR cooler effectiveness may be based on a suitable determination, such as based on the temperature of the EGR gas exiting the cooler being within a range of a predetermined desired temperature, based on a pressure drop across the EGR, based on a heat ratio of the EGR cooler, or another suitable method. At 404, routine 400 determines if EGR cooler effectiveness is below a threshold, for example if the cooling effectiveness is below 90% effective, the cooler may be determined to be relatively ineffective, and thus a regeneration of the EGR cooler may be indicated in order to remove built-up particulate matter. If at 404 the EGR cooler effectiveness is below a threshold, routine 400 indicates an EGR cooler regeneration restriction to the consist controller at 406. As described below with regard to FIG. 5, the regeneration restriction affects the load distribution among the plurality of engine-powered vehicles in the consist. If conditions for an EGR cooler regeneration have not been met at 400, routine 400 ends. Cooler regeneration may include flowing high temperature EGR through the cooler to remove accumulated soot (or other particulate matter). Alternatively, cooler regeneration may include flowing relatively cool EGR through the cooler to flake-off accumulated soot (or other particulate matter). The determination of whether to perform EGR cooler regeneration with cool exhaust or with hot exhaust may be based on current exhaust temperature. For example, if the engine with the EGR cooler to be regenerated is currently operating at low load and thus exhaust temperature is below a hot regeneration threshold, the EGR cooler may be regenerated according to a cold EGR cooler regeneration routine, where relatively cool exhaust is used to brake off accumulated soot. If the exhaust gas temperature is relatively high, for example if the engine is operating at high load and thus the exhaust temperature is above the hot regeneration temperature threshold, the EGR cooler may be regenerated according to a hot EGR cooler regeneration routine.

Thus, at 408, method 400 includes determining if exhaust temperature is below a threshold temperature, such as the threshold described above. If the exhaust temperature is above the threshold temperature, method 400 proceeds to 410 to indicate to the consist controller to perform a cold EGR cooler regeneration, as will be explained in more detail below with respect to FIG. 7. If the exhaust temperature is above the temperature threshold, method 400 proceeds to 412 to indicate to the consist controller to perform a hot EGR cooler regeneration, as will be explained in more detail below with respect to FIG. 9.

Routines 300 and 400 provide examples for determining a respective regeneration state for each engine's components, including each engine's EGR cooler and DPF. The consist controller can adjust power distribution among the plurality of engines taking into account each engine's EGR cooler and DPF status, as described in more detail below.

Figure 5:
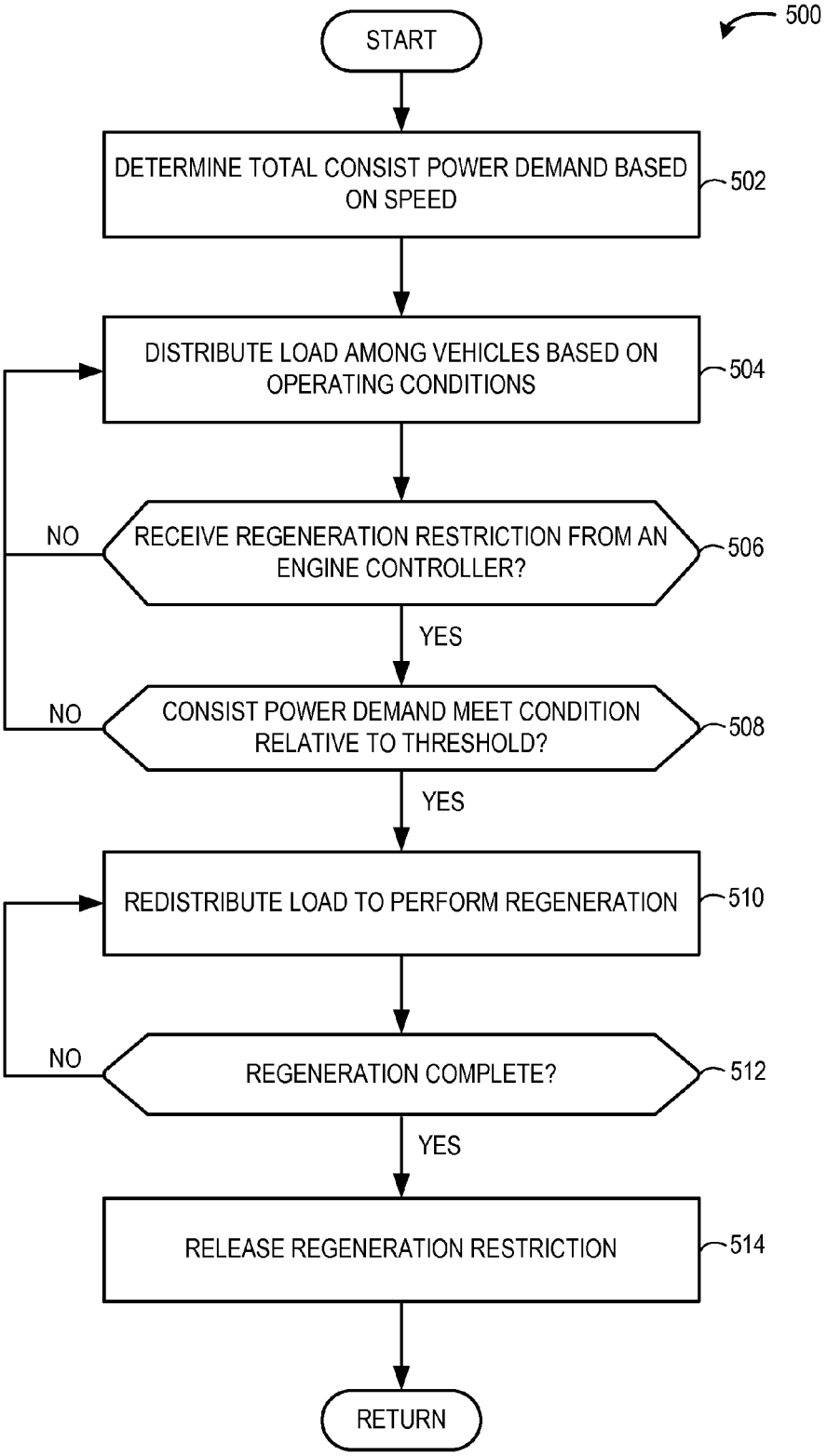
FIG. 5 is a flow diagram illustrating a method for distributing load in a consist according an embodiment of the present disclosure.

FIG. 5 is a flow diagram illustrating a method 500 for distributing load among a plurality of vehicles, such as locomotives, in a consist. Method 500 may be carried out by consist controller 22 in conjunction with data received from one or more engine controllers. Method 500 comprises, at 502, determining a total power demand for the consist. The total power demand may comprise a throttle setting established on one of the vehicles of the consist or on a remote vehicle linked with the consist as part of a greater consist. The throttle setting may be based on consist travel speed. The travel speed may be determined by an operator of the consist. In another embodiment, the travel speed and throttle settings may be automatically established by a control system, such as trip optimization software. The trip optimization software may generate a train trip plan and optimize speed, throttle settings, etc. along the route based on geographic location, track conditions, cargo load, fuel economy, emissions, etc. As explained with regard to FIG. 2, a notch throttle sets a discrete power level for a respective engine, and collectively each notch throttle of the consist dictates the speed of the consist. For example, if a consist includes three vehicles, such as consist 101 of FIG. 1, and the total power demand, or average consist notch setting, needed to obtain the desired speed is N5, the load distribution, and thus the notch settings for each vehicle, may be N5-N5-N5.

However, in some embodiments, not all vehicles in the consist will operate at the same throttle setting. The consist optimization software may distribute the load among the vehicles based on various operating conditions, as depicted at 504. The load distribution may be optimized to improve fuel economy in one example. In the example consist discussed above, the load may be redistributed from N5-N5-N5 to N7-N7-idle. By operating two vehicles at a higher notch setting and one at a lower notch setting, fuel efficiency may be improved under some conditions.

In addition to distributing load to optimize fuel efficiency, consist and vehicle operating conditions may be taken into account when determining the load distribution, as it may not be advantageous to increase or decrease load on particular vehicles. Example operating conditions include vehicle fuel levels, engine temperature, geographic position of each vehicle (e.g. in a tunnel, or traveling up an incline), vehicle wheel slip, force placed on the vehicles from trailing cargo, coupling forces, etc.

Method 500 comprises, at 506, determining if a regeneration restriction has been received from one or more engine controllers. As explained above with respect to FIGS. 2 and 3, each vehicle within the consist may include a DPF. Each engine controller within the consist may determine whether its respective DPF requires regeneration, and if so, indicate a regeneration restriction to the consist manager. In other embodiments, each engine controller within the consist may determine whether its respective EGR cooler requires regeneration, and if so, indicate a regeneration restriction to the consist manager. If, at 506, no regeneration restriction has been received, method 500 returns to 502 to continue the original load distribution plan. However, if a regeneration restriction has been received, method 500 advances to 508 to determine if the total consist power demand meets a predetermined condition relative to a threshold. When the consist controller receives a DPF regeneration restriction, it may set one or more vehicles at a predetermined throttle level, as explained in more detail below. However, if the consist power demand is below a threshold, such as a minimum throttle level for regeneration, the vehicle may not be allowed to operate at the predetermined throttle setting. For example, a regeneration restriction may be received by the consist controller, but if the consist is operating at idle, the vehicle requiring the regeneration may not be able to operate at the predetermined minimum throttle level, as it may cause too great a redistribution of engine power among the locomotives in the consist. The minimum throttle level for regeneration may be a designated minimum throttle level stored in the memory of the vehicle or consist controller, or it may be received over a communication link. Conversely, if the consist controller receives a restriction to regenerate the EGR cooler, total consist power demand may need to be below a threshold, as regenerating the EGR cooler may include sustained duration of low or no load engine operation. As such, if at 508, the total consist power demand does not meet a condition relative to a threshold, the method 500 returns to 502.

If the answer to the question at 508 is yes and it is determined total consist power demand meets a predetermined condition relative to a threshold, method 500 advances to 510 to redistribute load to perform the regeneration. Example methods of embodiments for performing a regeneration will be described in more detail with respect to FIGS. 6-10.

At 512, method 500 comprises determining if the regeneration is complete. Complete regeneration may be determined by an amount of time that has elapsed since the regeneration was initiated, or it may be determined based on sensor data. If the regeneration is complete, the regeneration restriction may be released at 514 and the method may return to determine load distribution without the restriction. If the regeneration is not complete, method 500 may continue to perform the regeneration at 510. However, in some embodiments, consist operating conditions may dictate disabling the regeneration before it is complete. For example, during a DPF regeneration, if the average consist throttle setting drops below a threshold due to operator input or the trip plan, the consist may not be able to operate at the load indicated to perform the regeneration. If regeneration is disabled before it is complete, the restriction may remain and the regeneration performed once the consist average throttle setting meets its condition relative to a threshold.

As illustrated, method 500 provides for reconfiguring a trip plan and load distribution responsive to regeneration of one or more engine components. However, it is possible for the consist manager to receive the regeneration restriction before the trip plan and load distribution is determined. In this case, the original trip plan may include the regeneration restriction. In such circumstances, the regeneration (of the particulate filter or the EGR cooler, for example) may be performed during a portion of the trip where the scheduled total power demand of the consist meets the condition relative to the threshold for performing the regeneration.

Figure 6:
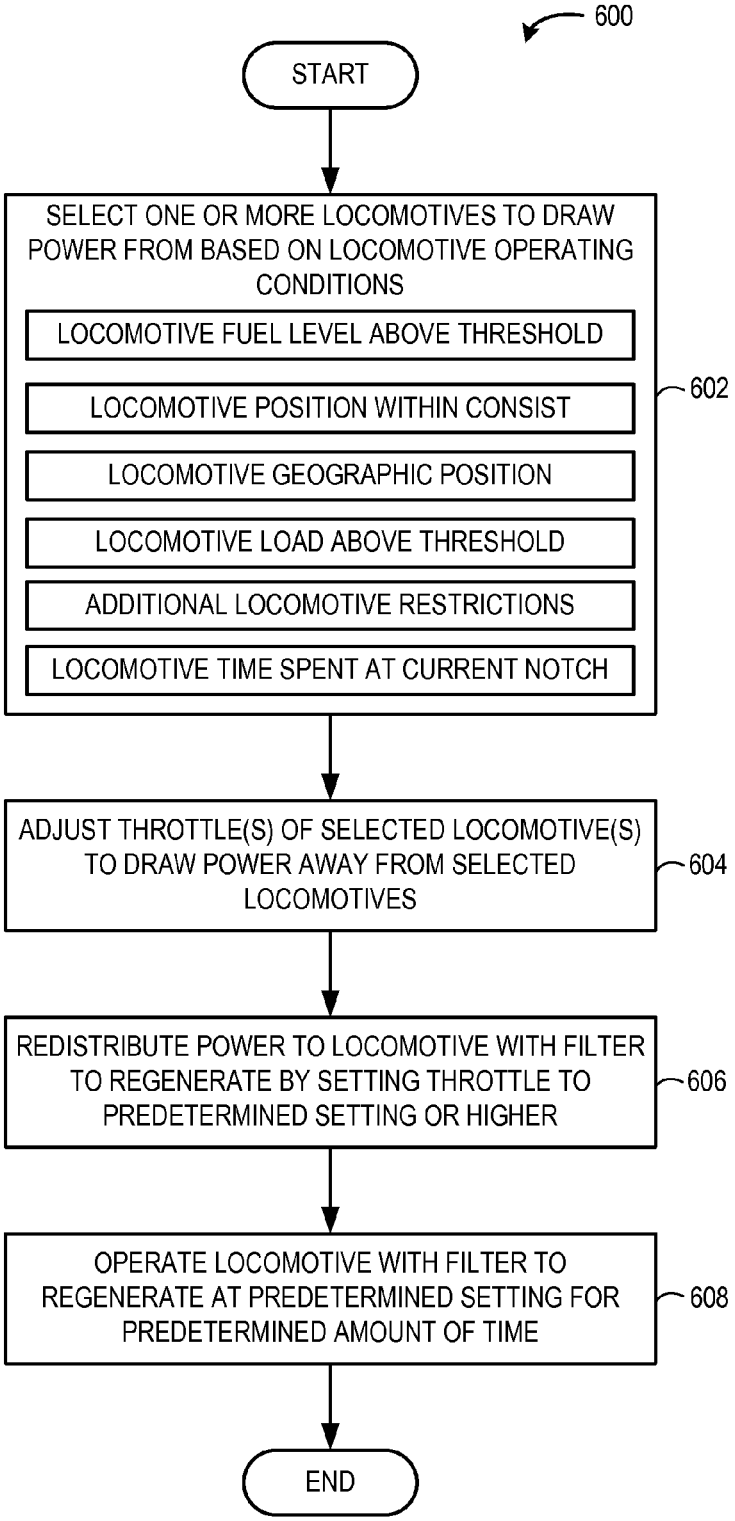
FIG. 6 is a flow diagram illustrating a method for performing a filter regeneration according an embodiment of the present disclosure.
Figure 7:
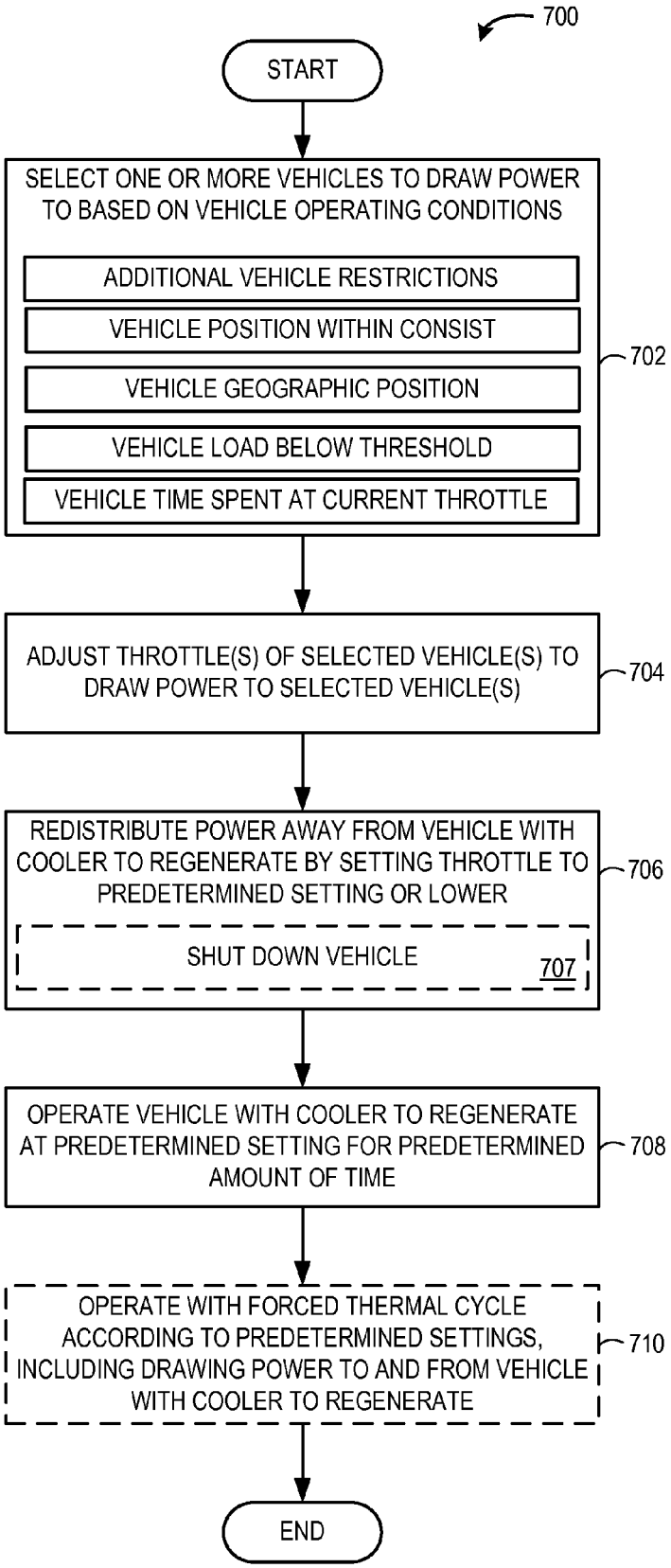
FIG. 7 is a flow diagram illustrating a method for performing an EGR cooler regeneration according an embodiment of the present disclosure.

FIGS. 6 and 7 illustrate example embodiments of methods to redistribute load based on regeneration restrictions. Turning to FIG. 6, a method 600 of distributing load based on a particulate filter regeneration is illustrated. Method 600 may be performed as part of method 500, for example it may be performed as part of process 510 of method 500. Method 600 may be carried out by consist controller 22. In order to perform the filter regeneration, power from one or more locomotives is redistributed to the locomotive including the filter to be regenerated. In this manner, the temperature of the exhaust flowing through the filter may increase to commence or sustain the regeneration. At 602, method 600 comprises selecting one or more locomotives from which to draw power based on locomotive operating conditions.

For example, various factors may cause one locomotive to have its engine power preferentially reduced relative to another locomotive. Locomotive fuel levels may affect the selection as locomotives with lower fuel levels may be preferentially selected to have power reduced to conserve fuel on that particular locomotive. Engine load may also affect the selection. For example, if engine load is below a threshold, it may be not be advantageous to further reduce load as exhaust temperature may drop causing emission control performance to drop. The position of the locomotive, including the position of the locomotive within the consist and the geographic position, may also affect the selection. For example, it may be desirable to draw power away from the lead locomotive to preferentially reduce engine noise for the train operators. The coupling forces between vehicles in the consist may also affect the selection, as the load distribution affects such forces. Grade may also affect the selection for redistribution of engine loads, as vehicles traveling on an incline may require a higher minimum engine load than one traveling on a decline. Further, whether a vehicle is currently traveling within a tunnel may affect the redistribution of power as further increasing engine load in a tunnel may degrade cooling capacity and increase over-temperature conditions. Additional restrictions, such as EGR cooler restrictions, may also influence the redistribution selection. Various examples of such influences are described in further detail below.

At 604, the throttles of the one or more selected locomotives are adjusted to draw engine power from the selected locomotives. At 606, the power is then redistributed to the locomotive including the filter to regenerate by setting the throttle of that locomotive to a predetermined setting or higher. In one embodiment, the predetermined setting is N3 or higher. The locomotive is operated at the predetermined setting for a predetermined amount of time, such as thirty minutes, to perform the regeneration at 608.

In a first example, if the consist controller sets an average notch setting of N2 with an predetermined load distribution of N2-N2-N2 and the first locomotive requires a regeneration, the load may be redistributed to N3-N1-N2 to perform the regeneration. However, the duration at which the second and third locomotive have been operating at the N2 setting may be determined in order to avoid extended operation at low load, which can degrade emissions. If it is determined the locomotives have been operating at low load conditions for a sufficient duration, filter regeneration may be delayed until the average consist notch setting increases. In another example, if the consist controller sets an average consist notch setting to N5 with a predetermined distribution of N7-N7-idle, and the third locomotive requires a regeneration, the load may be redistributed to N6-N6-N3. In some examples, when the load is distributed, engine output of one engine may decrease by a greater extent than engine output of another engine, based on operating conditions. For example, if the first locomotive has a lower fuel storage level than the second locomotive, the load may be distributed to N4-N6-N5 to extend operation of the first locomotive at a power level with a lower fuel consumption rate. In one embodiment, the fuel storage level may refer to an actual amount of fuel stored on-board the locomotive.

In other examples, the position of the locomotives receiving the additional load may influence how the load is distributed. Under some conditions, the load may preferentially be distributed away from a locomotive in a forward position to maintain load to locomotives in a rear position in order to balance forces within the consist, such as coupling forces. For example, if the average consist notch setting is N4, the consist is operating with a distribution of N5-N1-N6, and the second locomotive contains a filter to regenerate, the load may be distributed to N3-N3-N7 to draw power away from the first locomotive. However, if the first locomotive is traveling at an incline with respect to horizontal, such as climbing a hill, while the remaining locomotives are not (e.g. they are separated from the first locomotive by intervening rail cars), the load may instead be redistributed to N5-N3-N4 so that the first locomotive can sustain a high enough load to traverse the incline. In another example, if the first locomotive is traveling through a tunnel while the third locomotive is not, the load may be distributed to N2-N3-N7 to reduce over-temperature conditions of the first locomotive while performing the regeneration of the filter in the second locomotive. It is also possible to delay filter regeneration until no locomotives are traveling through a tunnel, in order to avoid degraded cooling capacity.

It is also possible for the consist controller to receive DPF regeneration restrictions for more than one DPF in the consist. Under some conditions, it may be possible for the load distribution to be adjusted to include operating more than one locomotive at or above the predetermined notch setting. For example, when selecting locomotives for which engine power settings are decreased, any locomotive having a filter in need of regeneration may be removed as a possibility. In this way, the DPFs may undergo regeneration at the same time. However, if the train power demand is too low to sustain more than one locomotive operating at the predetermined setting, the DPFs may be regenerated separately, for example in series, first redistributing power to a first engine with a filter needing regeneration, and then to a second engine with a filter needing regeneration. In terms of the above example starting at N2-N2-N2 with the first and second locomotive needing filter regeneration, the consist may first operate with N3-N1-N2 until regeneration of the first locomotive's filter is complete, and second operate with N2-N3-N1 until regeneration of the second locomotive's filter is complete. Also, this illustrates how none of the three locomotives was set to the lowest notch setting for both regeneration durations.

Thus, method 600 provides for performing a particulate filter regeneration that better utilizes fuel spent to increase exhaust temperature, as the increased engine load is utilized to drive the consist. As illustrated, the consist controller may automatically redistribute the engine load among locomotives of a consist or a train if the consist controller receives a DPF regeneration restriction. The redistribution operates such that the locomotive containing the indicated DPF may receive an adjusted amount of load, such as a notch throttle setting of N3 or higher, in order to raise exhaust temperature to a level to perform the filter regeneration. To maintain engine speed and load at a desired amount or within a desired range, one or more remaining locomotives may also concurrently receive an adjusted amount of load. After the regeneration is complete, such as after 30 minutes, the restriction may be released, and the trip plan and load distribution may be reconfigured to return to the original settings.

FIG. 7 illustrates a method 700 for distributing load based on a cold EGR cooler regeneration. If a consist controller receives a restriction to regenerate an EGR cooler, load to the vehicle containing the EGR cooler to be regenerated may be reduced in order to lower exhaust temperatures to perform the regeneration. In order to maintain average consist throttle setting, one or more remaining vehicles may receive increased power. Thus, method 700 comprises, at 702, selecting one or more vehicles to draw power to based on vehicle operating conditions. Similar to the method described with respect to FIG. 6, the vehicles may be selected based on one or more of variety of operating conditions, as explained below.

At 704, method 700 comprises adjusting throttles of the selected vehicles to redistribute engine power to the selected vehicles, e.g., increasing the throttles of the selected vehicles. At 706, power is redistributed away from the vehicle containing the cooler to be regenerated by setting the throttle of that vehicle to a predetermined setting or lower. For example, the predetermined setting may idle. In some examples, as indicated at 707, the predetermined setting may be to shut down the engine of the vehicle. Shutting down the engine may bring the core temperature of the EGR cooler close to ambient (e.g., 130° F. or 55° C. or below). The engine may be shut down for a suitable duration, such as for at least four hours. Before shutting down, the engine may be controlled to operate under a special short term condition to force the core temperature lower (e.g., high engine speed, low EGR cooler coolant temperature) to decrease the shutdown time. Cooling the EGR cooler core allows condensate to form within the cooler and cracks the soot/mud layer. Once the engine operation is resumed, it may be operated under a condition that results in a high Reynolds number (e.g., 5000-6000) to help shear/blow-off the soot that has loosened. At 708, the vehicle is operated at the predetermined setting for the predetermined amount of time, such as two hours, in order to perform the regeneration.

For example, if the second vehicle in the consist contains an EGR cooler to be regenerated, the consist controller may assess the remaining vehicles and determine which of the vehicles meets operating conditions to enable the reception of additional power. If the consist is operating with an average notch setting of N2, and the first vehicle has a lower fuel level than the third vehicle, the power may be redistributed from N2-N2-N2 biased to the third vehicle, such as N2-idle-N4. In another example, if a particulate filter regeneration restriction as explained above with respect to FIGS. 3 and 6, is placed on the first vehicle, the power may be distributed so that the first vehicle is set to N3 or higher, such as N3-idle-N3. In this way, it may be possible to perform the EGR cooler regeneration while performing the particulate filter regeneration.

Method 700 may optionally include performing a forced thermal cycle at 710. The forced thermal cycle may include operating the EGR cooler at alternating cold-hot-cold-hot cycles. For example, the EGR cooler may initially be operated at a relatively low exhaust temperature, as explained above, by reducing the power output by the engine coupled to the EGR cooler being regenerated (and concomitantly increasing the power output of one or more additional engines in the consist). After a predetermined amount of time, such as thirty minutes, an hour, or other suitable time, the power output of the engine coupled to the EGR cooler may be increased, in order to increase the temperature of the exhaust (and the power output of one or more other engines in the consist may be lowered to maintain traveling speed). This cycle may be repeated as desired to perform the regeneration.

Figure 9:
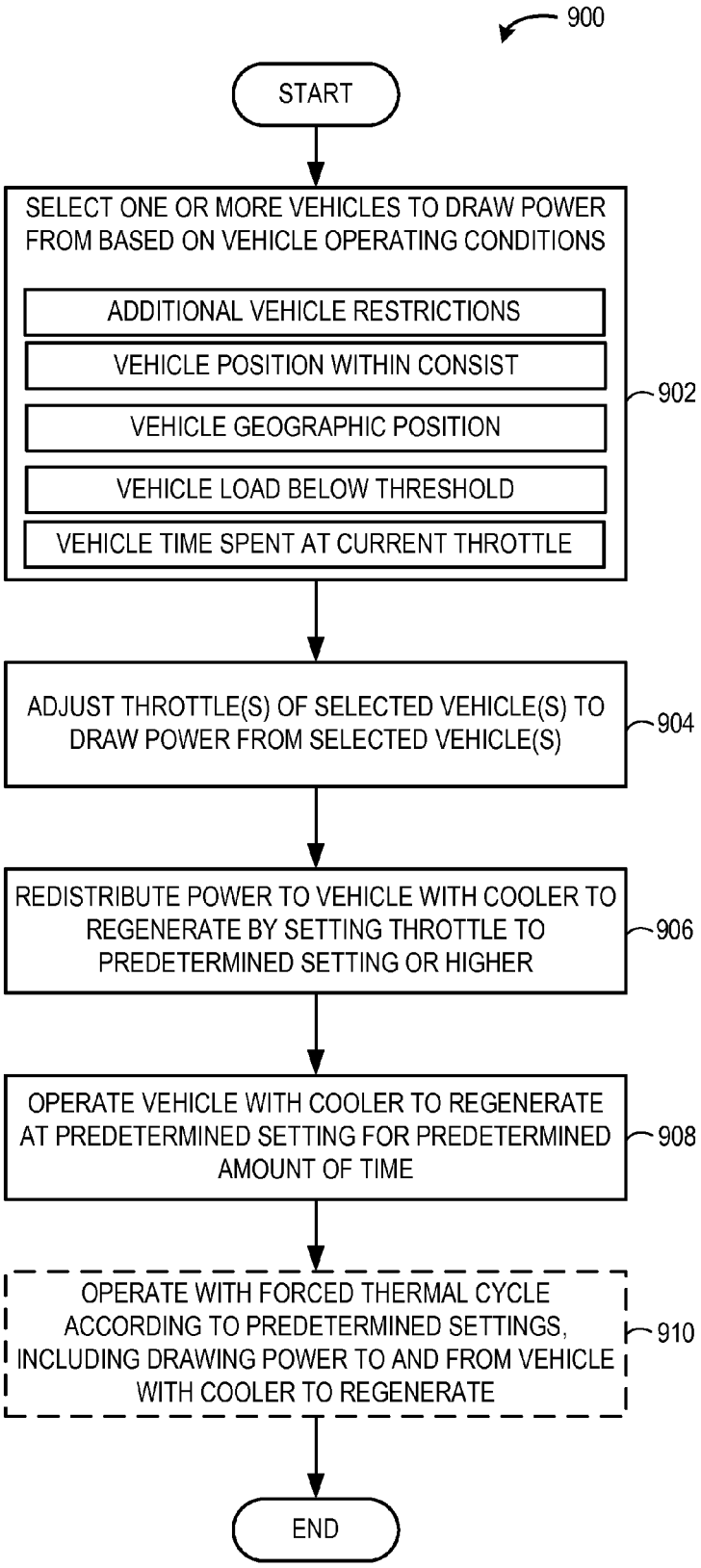
FIG. 9 is a flow diagram illustrating a method for performing an EGR cooler regeneration according another embodiment of the present disclosure.

FIG. 9 illustrates a method 900 for distributing load based on a hot EGR cooler regeneration. If a consist controller receives a restriction to regenerate an EGR cooler, load to the vehicle containing the EGR cooler to be regenerated may be increased in order to increase exhaust temperatures to perform the regeneration. In order to maintain average consist throttle setting, one or more remaining vehicles may receive decreased power. Thus, method 900 comprises, at 902, selecting one or more vehicles to draw power from based on vehicle operating conditions. Similar to the method described with respect to FIG. 6, the vehicles may be selected based on one or more of variety of operating conditions, as explained below.

At 904, method 900 comprises adjusting throttles of the selected vehicles to draw engine power from the selected vehicles, e.g., decreasing the throttle settings of the selected vehicles. At 906, power is redistributed to the vehicle containing the cooler to be regenerated by setting the throttle of that vehicle to a predetermined setting or higher. For example, the predetermined setting may be N3 or higher. At 908, the vehicle is operated at the predetermined setting for the predetermined amount of time, such as two hours, in order to perform the regeneration.

For example, if the second vehicle in the consist contains an EGR cooler to be regenerated, the consist controller may assess the remaining vehicles and determine which of the vehicles meets operating conditions to enable the reduction of power. If the consist is operating with an average notch setting of N2, and the first vehicle has a lower fuel level than the third vehicle, the power may be redistributed from N2-N2-N2 biased away from the third vehicle, such as N2-N3-N1.

Method 900 may optionally include performing a forced thermal cycle at 910. The forced thermal cycle may include operating the EGR cooler at alternating cold-hot-cold-hot cycles. For example, the EGR cooler may initially be operated at a relatively high exhaust temperature, as explained above, by increasing the power output by the engine coupled to the EGR cooler being regenerated (and concomitantly decreasing the power output of one or more additional engines in the consist). After a predetermined amount of time, such as thirty minutes, an hour, or other suitable time, the power output of the engine coupled to the EGR cooler may be decreased, in order to decrease the temperature of the exhaust (and the power output of one or more other engines in the consist may be increased to maintain traveling speed). This cycle may be repeated as desired to perform the regeneration.

As explained above, various factors may cause one vehicle to have its engine power preferentially reduced or increased relative to another vehicle. Vehicle fuel levels may affect the selection, as vehicles with lower fuel levels may be preferentially selected to have power reduced to conserve fuel on that particular vehicle. Engine load may also affect the selection. For example, if engine load is below a threshold, it may be not be advantageous to further reduce load as exhaust temperature may drop causing emission control performance to drop. The position of the vehicle, including the position of the vehicle within the consist and the geographic position, may also affect the selection. For example, it may be desirable to draw power away from the lead vehicle to preferentially reduce engine noise for the consist operators. The coupling forces between vehicles in the consist may also affect the selection, as the load distribution affects such forces. Grade may also affect the selection for redistribution of engine loads, as vehicles traveling on an incline may require a higher minimum engine load than one traveling on a decline. Further, whether a vehicle is currently traveling within a tunnel may affect the redistribution of power as further increasing engine load in a tunnel may degrade cooling capacity and increase over-temperature conditions. Additional restrictions, such as particulate filter regeneration restrictions, may also influence the redistribution selection. In some examples, when the load is distributed, engine output of one engine may increase by a greater extent than engine output of another engine, based on operating conditions. In one embodiment, the fuel storage level may refer to an actual amount of fuel stored on-board the vehicle.

In other examples, the position of the vehicles receiving the additional load may influence how the load is distributed. Under some conditions, the load may preferentially be distributed away from a vehicle in a forward position to maintain load to vehicles in a rear position in order to balance forces within the consist, such as coupling forces. For example, if the average consist notch setting is N4, the consist is operating with a distribution of N5-N1-N6, and the second vehicle contains an EGR cooler to regenerate using a hot regeneration routine, the load may be distributed to N3-N3-N7 to draw power away from the first locomotive. However, if the first vehicle is traveling at an incline with respect to horizontal, such as climbing a hill, while the remaining vehicles are not (e.g. they are separated from the first vehicle by intervening rail cars, for example), the load may instead be redistributed to N5-N3-N4 so that the first vehicle can sustain a high enough load to traverse the incline. In another example, if the first locomotive is traveling through a tunnel while the third locomotive is not, the load may be distributed to N2-N3-N7 to reduce over-temperature conditions of the first locomotive while performing the regeneration of the EGR cooler in the second locomotive. It is also possible to delay EGR cooler regeneration until no locomotives are traveling through a tunnel, in order to avoid degraded cooling capacity.

In examples where a cold EGR cooler regeneration routine is being performed, the vehicle or vehicles which are selected to receive additional power may be selected based on similar factors. As explained above, a vehicle traveling at an incline may preferentially receive additional power as compared to a vehicle that is not traveling at an incline. Likewise, a vehicle that is not in a tunnel may receive additional power over a vehicle that is located in a tunnel.

It is also possible for the consist controller to receive EGR cooler regeneration restrictions for more than one EGR cooler in the consist. Under some conditions, it may be possible for the load distribution to be adjusted to include operating more than one vehicle at the predetermined throttle setting for performing the regenerations. For example, if a hot EGR cooler regeneration is indicated for a first vehicle, when selecting vehicles for which engine power settings are decreased, any other vehicle having an EGR cooler in need of regeneration may be selected, and a cold EGR regeneration may be performed. In this way, the EGR coolers may undergo regeneration at the same time.

As explained above, the power distribution among vehicles traveling in a consist may be adjusted in order to perform a regeneration of a particulate filter and/or an EGR cooler. When power is increased in one vehicle, power is concomitantly decreased in one or more other vehicles. Due to the mechanical coupling of the vehicles in the consist, overall traveling speed is maintained. However, as explained previously, some consists may be communicatively, but not necessarily mechanically, coupled. If one vehicle were to increase power and another vehicle were to decrease power, a collision may result. To avoid collisions during power adjustment in a consist where vehicles are not necessarily mechanically coupled, if one vehicle undergoes an increase or decrease in power, the other vehicles in the consist may also undergo a similar adjustment in power output.

Figure 8:
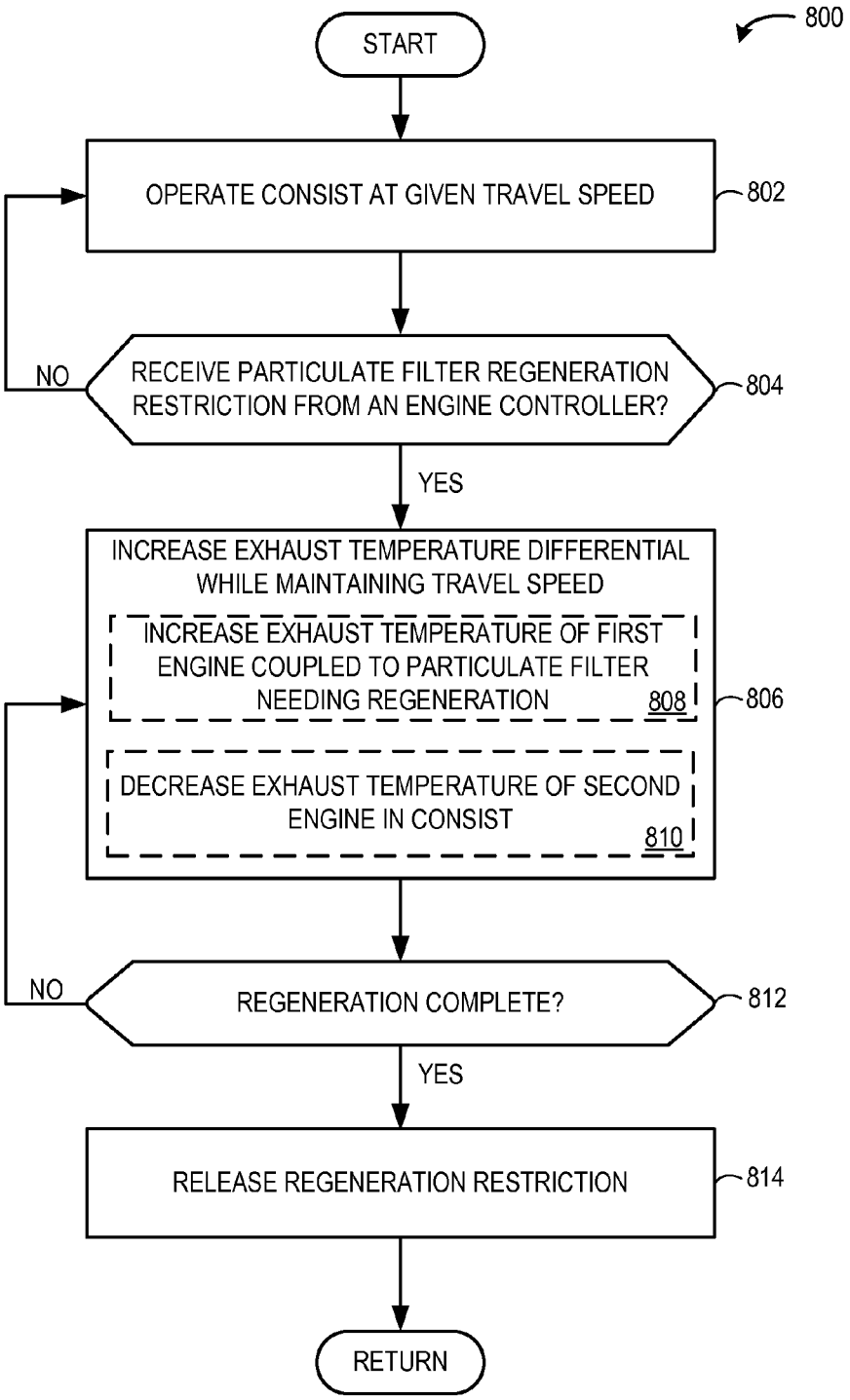
FIG. 8 is a flow diagram illustrating a method for performing a regeneration according to another embodiment of the present disclosure.

FIG. 8 illustrates another embodiment including a method 800 for controlling exhaust temperature of rail vehicle engines of a plurality of rail vehicles in a consist in order to perform a particulate filter regeneration. Method 800 may be carried out by consist controller 22. Method 800 comprises, at 802, operating the consist at a given travel speed. The travel speed may be determined by an operator of the train, or the travel speed and respective notch settings may be automatically established by a control system, such as trip optimization software. The trip optimization software may generate a train trip plan and optimize speed, notch settings, etc. along the route based on geographic location, track conditions, cargo load, fuel economy, emissions, etc. Further, as explained with respect to FIG. 5, the consist optimization software may distribute the load among the rail vehicles of the consist in order to optimize various operating parameters, such as fuel consumption.

At 804, method 800 comprises determining if a particulate filter regeneration restriction has been received. If a particulate filter coupled to an engine of a rail vehicle of the consist requires regeneration, a restriction will be passed to the consist controller, as explained above with respect to FIGS. 3 and 5. If no restriction has been received, method 800 continues to operate the consist at the given travel speed following the established trip plan. If a restriction has been received and a particulate filter is in a regeneration mode, method 800 proceeds to 806 to perform a particulate filter regeneration by increasing an exhaust temperature differential between the engine (in one rail vehicle) coupled to the particulate filter and one or more additional engines in other rail vehicles of the consist, while maintaining the given travel speed. For example, at 808, the exhaust temperature of a first engine coupled to the filter to be regenerated may be increased, while the exhaust temperature of a second engine in the consist may be decreased at 810 or maintained substantially at the same temperature.

In one embodiment, the exhaust temperature of the first engine may be increased by increasing a fuel injection amount of the first engine. Concurrently, the exhaust temperature of one or more second engines may be decreased by decreasing a fuel injection amount of the one or more second engines. Alternatively, the exhaust temperature of one or more second engines may not decrease, even though the fuel injection amount is decreased, as the fuel injection timing may be adjusted and/or due to other airflow effects of reducing engine load. Additionally, or alternatively, the throttles of the respective engines may be varied to adjust exhaust temperature. The exhaust temperature adjustments may be performed in such a way that the given travel speed of the consist is maintained, as the counteracting adjustments among the engines operate to maintain an overall operation of the consist. In other embodiments, the exhaust temperature of the first engine and the one or more second engines may be adjusted by adjusting fuel injection timing, adjusting the amount of EGR, etc.

In some embodiments, the exhaust temperature of the first engine may be increased by a predetermined temperature. For example, the exhaust temperature may be increased by 30° C., or by 35° C., or it may be increased in a range from 30 to 100° C. Depending on the level of the decrease in the exhaust temperature of the one or more second engines, the exhaust temperature differential between the first engine and a second engine may be similar to the exhaust temperature increase of the first engine, or it may be greater.

At 812, method 800 comprises determining if the regeneration is complete. Complete regeneration may be determined by an amount of time that has elapsed since the regeneration was initiated, such as 30 minutes, or it may be determined based on sensor data. If the regeneration is complete, the regeneration restriction may be released at 814 and the method may return to continue to operate the consist at the given travel speed based on the trip plan as the temperature differential is decreased and the exhaust temperatures of the engines are returned to non-regeneration levels. If the regeneration is not complete, method 800 may continue to perform the regeneration at 806.

As explained above, first and second rail vehicles of a consist may be controlled to advantageously perform a filter regeneration by adjusting the relative exhaust temperatures. Further, the approach may be extended to more than two rail vehicle, such as an example including a first, second, and third rail vehicle, each with an engine where the exhaust temperature of one rail vehicle is temporarily increased while the exhaust temperature of the second and third rail vehicles is temporarily decreased in order to regenerate a particulate filter of the first rail vehicle and also maintain the overall output or traveling speed of the consist (even as the various temperature are adjusted). In this way, the consist continues to operate according to its intended trip plan without generating excess or wasted engine output, even during filter regeneration conditions where exhaust temperatures are adjusted.

In one embodiment, during traveling of the consist at a given speed, the method adjusts both a first engine of the first vehicle and a second engine of the second vehicle to temporarily increase an exhaust temperature differential between exhaust temperature of the first engine and exhaust temperature of the second engine. The first engine's exhaust temperature is temporarily increased to regenerate a particulate filter coupled to the first engine, while the given speed of the consist is maintained. The temporary increase in the exhaust temperature may include an increase of at least a threshold temperature amount, such as 30° C. as noted above, for a given regeneration duration, such as a threshold duration of time. The exhaust temperature differential may be increased in response to an indication that the particulate filter coupled to the first engine is in a regeneration mode, for example based on pressure differential across the filter or an estimated particulate loading of the filter. Another embodiment relates to a method of controlling a rail vehicle consist, e.g., a group of two or more locomotives coupled adjacent one another as a sub-part of a train or otherwise. The method comprises controlling all vehicles of the consist to achieve a designated total power level (e.g., tractive effort) of the consist. The total power level may be designated by a controller, for example, as part of a control strategy generated by an energy management system. During a time when the vehicles are controlled to achieve the designated total power level, the consist enters a filter regeneration mode for a first vehicle of the consist. (Here, "first" merely means the mode is entered into for one of the vehicles of the consist, with "first" differentiating that vehicle from others in the consist for purposes of explanation herein.) The filter regeneration mode is a designation or determination that a filter in the first vehicle is to be regenerated, e.g., based on estimates of filter loading. In the filter regeneration mode, if the designated total power level is equal to or greater than a designated minimum power level of the first vehicle for filter regeneration, the first vehicle is controlled to at least the designated minimum power level. Additionally, one or more second vehicles of the consist are controlled to achieve a power level comprising a difference between the designated total power level and the power level to which the first rail vehicle is controlled (i.e., at least the designated minimum power level). On the other hand, if the designated total power level is less than the designated minimum power level for filter regeneration, the consist is controlled to achieve the designated total power level, despite the filter regeneration mode.

Another embodiment relates to a method of controlling first and second rail vehicles in a consist. The method comprises, during traveling of the consist, adjusting both a first engine of the first vehicle and a second engine of the second vehicle to temporarily establish an exhaust temperature differential between an exhaust temperature of the first engine and an exhaust temperature of the second engine, to regenerate a particulate filter coupled to the first engine. The exhaust temperature differential is at least 30 degrees C. In another embodiment, the exhaust temperature differential is established while maintaining a given speed of the consist, e.g., meeting or exceeding a speed of the consist at the time of commencing establishment of the exhaust temperature differential.

In one embodiment, a method for controlling a rail vehicle consist comprises receiving information of a total power demand for the rail vehicle consist, automatically controlling a respective throttle of each of a first rail vehicle and one or more second rail vehicles of the consist based on the total power demand, and in a filter regeneration mode for the first rail vehicle, automatically controlling the throttle of the first rail vehicle to at least a minimum throttle level for filter regeneration, and automatically controlling the respective throttle of each of the one or more second rail vehicles based on the total power demand.

In another embodiment, the method includes the minimum throttle level being a designated minimum throttle level stored in a memory or received over a communication link. The method also includes automatically controlling the throttle of the first rail vehicle below the designated minimum throttle level if the total power demand is less than the designated minimum throttle level. The method includes the information of the total power demand relating to a throttle setting established on one of the rail vehicles of the consist or on a remote rail vehicle linked with the consist as part of a greater consist. The method comprises the throttle setting being established by a human operator and also comprises the throttle setting being established by a control system.

In another embodiment, the method includes the rail vehicle consist being part of a greater consist, and the information of the total power demand relating to a throttle setting established on a remote rail vehicle of the greater consist, wherein in the filter regeneration mode, the throttles of the first and second rail vehicles are concurrently automatically controlled for filter regeneration of the first rail vehicle and to match the total power demand. The filter regeneration mode may be initiated in response to receiving information relating to the filter regeneration. The method includes, in the filter regeneration mode, the throttle of the first rail vehicle being automatically controlled to at least the minimum throttle level for filter regeneration, and the respective throttle of each of the one or more second rail vehicles being concurrently automatically controlled for the rail vehicle consist to match the total power demand, wherein the minimum throttle level is a designated minimum throttle level stored in a memory or received over a communication link. The method further comprises, in the filter regeneration mode, the throttle of the first rail vehicle being automatically increased from a lower throttle level to the designated minimum throttle level, and wherein the respective throttle of each of the one or more second rail vehicles being concurrently automatically decreased based on the total power demand.

In another embodiment, the method further comprises automatically controlling the throttle of the first rail vehicle below the minimum throttle level if the total power demand is less than the minimum throttle level. The method includes initiating the filter regeneration mode based on a signal received relating to a filter load of the first rail vehicle. The method also includes the throttles of the first and second rail vehicles being controlled to different throttle levels.

In another embodiment, a method for controlling a train comprises, at a first locomotive of a locomotive consist comprising the first locomotive, a second locomotive, and a third locomotive, receiving first information relating to a total power demand for the locomotive consist, wherein the first information is received from a remote locomotive in the train, the locomotive consist and the remote locomotive being spaced apart by at least one non-powered rail car. The method also comprises receiving second information relating to filter regeneration of one of the first, second, or third locomotives. If the total power demand is lower than a minimum throttle level for filter regeneration of said one of the first, second, or third locomotives, a respective throttle of each of the first, second, and third locomotives is automatically controlled based on the total power demand, and if the total power demand is greater than the minimum throttle level, the throttle of said one of the first, second, or third locomotives is automatically controlled to at least the minimum throttle level, and concurrently, the respective throttle of each other of said one of the first, second, or third locomotives is automatically controlled based on the total power demand.

In another embodiment, the method includes, if the total power demand is lower than the minimum throttle level, automatically controlling the respective throttle of each of the first, second, and third locomotives for the locomotive consist to meet the total power demand, and if the total power demand is greater than the minimum throttle level, automatically controlling the throttle of said one of the first, second, or third locomotives to at least the minimum throttle level, and concurrently automatically controlling the respective throttle of each other of said one of the first, second, or third locomotives for the locomotive consist to meet the total power demand.

In another embodiment, a system for controlling a rail vehicle consist comprises a control module comprising a communication portion (e.g., communication sub-module) and a control signal portion (e.g., control signal sub-module) operably coupled to the communication portion. The communication portion is configured to receive information of a total power demand for the rail vehicle consist. The control signal portion is configured to generate control signals for automatically controlling a respective throttle of each of a first rail vehicle and one or more second rail vehicles of the consist based on the total power demand. The control signal portion includes a filter regeneration mode, wherein the control signal portion is configured, when operating in the filter regeneration mode, to generate the control signals for automatically controlling the throttle of the first rail vehicle to at least a minimum throttle level for filter regeneration and the respective throttle of each of the one or more second rail vehicles based on the total power demand.

In another embodiment of the system, the control signal portion is configured, when in the filter regeneration mode, to generate the control signals for automatically controlling the throttle of the first rail vehicle to at least the minimum throttle level for filter regeneration and the respective throttle of each of the one or more second rail vehicles for the consist to meet the total power demand.

Figure 10:
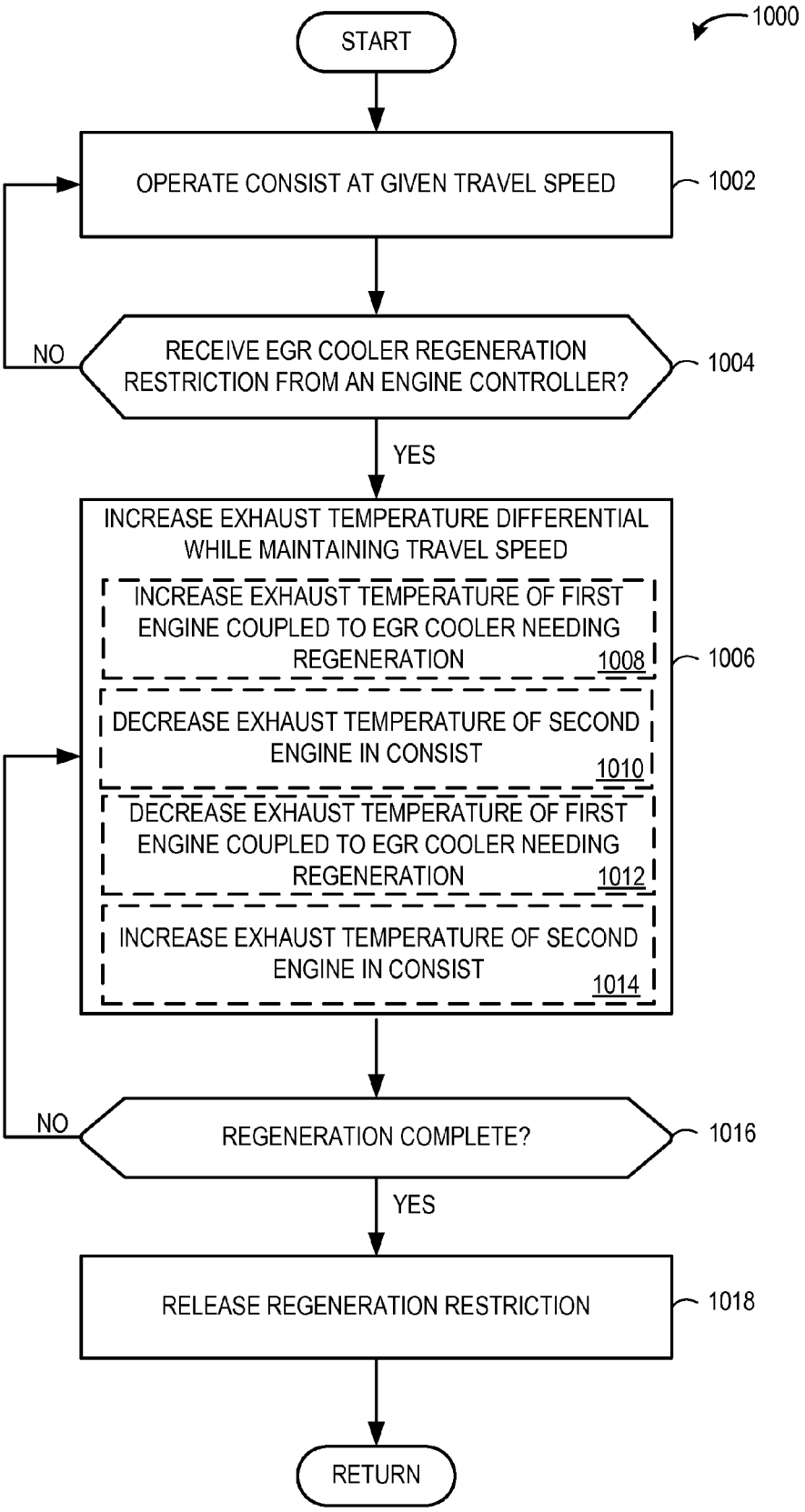
FIG. 10 is a flow diagram illustrating a method for performing a regeneration according to a further embodiment of the present disclosure.

FIG. 10 illustrates another embodiment including a method 1000 for controlling exhaust temperature of vehicle engines of a plurality of vehicles in a consist in order to perform an EGR device, such as an EGR cooler, regeneration. Method 1000 may be carried out by consist controller 22. Method 1000 comprises, at 1002, operating the consist at a given travel speed. The travel speed may be determined by an operator of the consist, or the travel speed and respective throttle settings may be automatically established by a control system, such as trip optimization software. The trip optimization software may generate a train trip plan and optimize speed, throttle settings, etc. along the route based on geographic location, track conditions, cargo load, fuel economy, emissions, etc. Further, as explained with respect to FIG. 5, the consist optimization software may distribute the load among the vehicles of the consist in order to optimize various operating parameters, such as fuel consumption.

At 1004, method 1000 comprises determining if an EGR cooler regeneration restriction has been received. If an EGR cooler coupled to an engine of a vehicle of the consist requires regeneration, a restriction will be passed to the consist controller, as explained above with respect to FIGS. 4 and 5. If no restriction has been received, method 1000 continues to operate the consist at the given travel speed following the established trip plan. If a restriction has been received and an EGR cooler is in a regeneration mode, method 1000 proceeds to 1006 to perform an EGR cooler regeneration by increasing an exhaust temperature differential between the engine (in one vehicle) coupled to the EGR cooler and one or more additional engines in other vehicles of the consist, while maintaining the given travel speed. For example, at 1008, the exhaust temperature of a first engine coupled to the cooler to be regenerated may be increased, while the exhaust temperature of a second engine in the consist may be decreased at 1010 or maintained substantially at the same temperature. In another example, at 1012, the exhaust temperature of the first engine coupled to the EGR cooler to be regenerated may be decreased, while the exhaust temperature of the second engine in the consist may be increased at 1014.

In one embodiment, the exhaust temperature of the first engine may be increased by increasing a fuel injection amount of the first engine, or the exhaust temperature of the first engine be decreased by decreasing a fuel injection amount of the first engine. Concurrently, the exhaust temperature of one or more second engines may be decreased by decreasing a fuel injection amount of the one or more second engines, or increased by increasing a fuel injection amount of the one or more second engines. Alternatively, the exhaust temperature of one or more second engines may not change, even though the fuel injection amount is changed, as the fuel injection timing may be adjusted and/or due to other airflow effects of reducing or increasing engine load. Additionally, or alternatively, the throttles of the respective engines may be varied to adjust exhaust temperature. The exhaust temperature adjustments may be performed in such a way that the given travel speed of the consist is maintained, as the counteracting adjustments among the engines operate to maintain an overall operation of the consist. In other embodiments, the exhaust temperature of the first engine and the one or more second engines may be adjusted by adjusting fuel injection timing, adjusting the amount of EGR, etc.

In some embodiments, the exhaust temperature of the first engine may be increased by a predetermined temperature. For example, the exhaust temperature may be increased by 30° C., or by 35° C., or it may be increased in a range from 30 to 100° C. Depending on the level of the decrease in the exhaust temperature of the one or more second engines, the exhaust temperature differential between the first engine and a second engine may be similar to the exhaust temperature increase of the first engine, or it may be greater. In other embodiments, the exhaust temperature of the first engine may be decreased by a predetermined temperature. For example, the exhaust temperature may be decreased by 30° C., or by 35° C., or it may be decreased in a range from 30 to 100° C. Depending on the level of the increase in the exhaust temperature of the one or more second engines, the exhaust temperature differential between the first engine and a second engine may be similar to the exhaust temperature decrease of the first engine, or it may be greater.

At 1016, method 1000 comprises determining if the regeneration is complete. Complete regeneration may be determined by an amount of time that has elapsed since the regeneration was initiated, such as 30 minutes, or it may be determined based on sensor data. If the regeneration is complete, the regeneration restriction may be released at 1018 and the method may return to continue to operate the consist at the given travel speed based on the trip plan as the temperature differential is decreased and the exhaust temperatures of the engines are returned to non-regeneration levels. If the regeneration is not complete, method 1000 may continue to perform the regeneration at 1006.

Thus, the systems and methods described herein provide for an embodiment for a system, comprising: a controller including non-transitory media having instructions stored on the media and executed by the controller for: adjusting distribution of engine output between at least a first engine and a second engine in response to a regeneration mode, wherein the regeneration mode regenerates an exhaust gas recirculation (EGR) cooler that is coupled to the first engine.

Adjusting the distribution of engine output includes decreasing engine output of the first engine and increasing engine output of the second engine. The instructions further include instructions for increasing engine output of a third engine. Adjusting the distribution of the engine output comprises adjusting a throttle setting, and the instructions further include instructions for maintaining an overall engine output level for the first and second engines during the adjusting of the distribution. The instructions further include instructions for disabling the EGR cooler regeneration when demand for overall engine power output is above a threshold value.

Each of the first and second engines is disposed in a respective first vehicle and second vehicle, and the first and second vehicles are coupled, mechanically and/or communicatively, to each other to form a consist. Adjusting engine output is based at least in part on an estimated effectiveness of the cooler. Adjusting engine output is further based at least in part on one or more conditions associated with a particulate filter coupled to the second engine. A combined engine output of the first engine and the second engine remains about constant while the distribution of engine output between the first engine and the second engine changes. The consist maintains an about constant traveling speed while the distribution of engine output between the first engine and the second engine changes.

Another embodiment relates to a system comprising: a consist including a first vehicle with a first engine and a second vehicle with a second engine; and one or more sensors communicatively coupled to a controller that is configured to: operate the vehicles in the consist at a determined traveling speed; determine an effectiveness level of an EGR device coupled to the first engine based at least in part on a signal from the one or more sensors; compare the determined effectiveness level to a determined effectiveness threshold value, and selectively initiate a regeneration operation for the first EGR device; adjust the first engine power output to a first power output level during the regeneration operation; and adjust the second engine power output to a second, different power output level during the regeneration operation.

To adjust the first engine power output, the controller controls a throttle setting to be at a determined setting, and the EGR device effectiveness is determined based at least in part on a measured temperature of exhaust gas immediately upon exiting the EGR device. In an example, the controller is configured to adjust engine output based at least in part on one or more conditions associated with a particulate filter coupled to the second engine.

The second engine is one of a plurality of second engines in the consist, and the controller is configured to adjust power output by at least two or more of the second engines of the plurality of second engines. Power output is adjusted at different power levels among the two or more of the second engines of the plurality of second engines to maintain an about constant or an about homogeneous traveling speed of all the vehicles in the consist, and all of the vehicles in the consist are communicatively, but not mechanically, coupled to each other, and therefore to avoid collisions between all of the vehicles in the consist.

In an example, the combined output of the first engine and the second engine remains about constant while the distribution of engine output between the first engine and the second engine changes, and wherein the consist maintains an about constant traveling speed while the distribution of engine output between the first engine and the second engine changes.

Another embodiment relates to a method that comprises adjusting (e.g., with a controller) a distribution of engine output between at least a first engine and a second engine in response to initiation of a regeneration mode. The regeneration mode regenerates an exhaust gas recirculation (EGR) cooler that is coupled to the first engine.

In another embodiment of the method, adjusting (e.g., with the controller) the distribution of engine output includes decreasing an engine output of the first engine and increasing an engine output of the second engine. The method may further comprise disabling or postponing initiation of the regeneration mode in response to a demand for combined engine power output of the first and second engines that is above a threshold engine power output value.

In another embodiment, the method further comprises maintaining (e.g., with the controller) a combined output of the first engine and the second engine at an about constant level despite the distribution of engine output between the first engine and the second engine changing or being adjusted.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a controller including non-transitory media having instructions stored on the media and executed by the controller for:

adjusting distribution of engine output between at least a first engine and a second engine in response to a regeneration mode, wherein the regeneration mode regenerates an exhaust gas recirculation (EGR) cooler that is coupled to the first engine.

2. The system of claim 1, wherein adjusting the distribution of engine output includes decreasing engine output of the first engine and increasing engine output of the second engine.

3. The system of claim 2, wherein the instructions further include instructions for adjusting engine output between the first engine and a third engine in response to the regeneration mode, the adjusting including increasing engine output of the third engine.

4. The system of claim 1, wherein adjusting the distribution of the engine output comprises adjusting a throttle setting, and wherein the instructions further include instructions for maintaining an overall engine output level for the first and second engines during the adjusting of the distribution.

5. The system of claim 1, wherein adjusting distribution of engine output between at least the first engine and the second engine in response to the regeneration mode comprises shutting down the first engine and increasing engine output of the second engine, and wherein the instructions further include instructions for disabling the EGR cooler regeneration when demand for overall engine power output is above a threshold value.

6. The system of claim 1, wherein each of the first and second engines is disposed in a respective first vehicle and second vehicle, and the first and second vehicles are coupled, at least one of mechanically or communicatively, to each other to form a consist.

7. The system of claim 6, wherein adjusting engine output is based at least in part on an estimated effectiveness of the cooler.

8. The system of claim 6, wherein adjusting engine output is further based at least in part on one or more conditions associated with a particulate filter coupled to the second engine.

9. The system of claim 6, wherein a combined engine output of the first engine and the second engine remains about constant while the distribution of engine output between the first engine and the second engine changes, and wherein the controller is configured to control the consist to maintain an about constant traveling speed while the distribution of engine output between the first engine and the second engine changes.

10. The system of claim 1, wherein the controller adjusts the distribution of engine output between at least the first engine and the second engine in response to the regeneration mode to perform a thermal cycle, where engine output of the first engine alternates between increased engine output and decreased engine output.

11. A system, comprising:

a consist including a first vehicle with a first engine and a second vehicle with a second engine; and one or more sensors communicatively coupled to a controller that is configured to:

operate the vehicles in the consist at a determined traveling speed;

determine an effectiveness level of an exhaust gas recirculation (EGR) device coupled to the first engine based at least in part on a signal from the one or more sensors;

based on a comparison of the determined effectiveness level to a determined effectiveness threshold value selectively initiate a regeneration operation for the EGR device;

adjust the first engine power output to a first power output level during the regeneration operation; and adjust the second engine power output to a second, different power output level during the regeneration operation.

12. The system of claim 11, wherein to adjust the first engine power output, the controller is configured to control a throttle setting to be at a determined setting, and the controller is configured to determine the effectiveness level of the EGR device based at least in part on a measured temperature of exhaust gas immediately upon exiting the EGR device.

13. The system of claim 11, wherein the second engine is one of a plurality of second engines in the consist, and the controller is configured to adjust power output by at least two or more of the second engines of the plurality of second engines.

14. The system of claim 13, wherein the controller is configured to adjust the power output by the at least two or more of the second engines at different power levels among the two or more of the second engines of the plurality of second engines to maintain an about constant or an about homogeneous traveling speed of all the vehicles in the consist, and all of the vehicles in the consist are communicatively, but not mechanically, coupled to each other, and therefore to avoid collisions between all of the vehicles in the consist.

15. The system of claim 11, wherein the controller is configured to adjust the first engine output and the second engine output based at least in part on one or more conditions associated with a particulate filter coupled to the second engine.

16. The system of claim 11, wherein a combined engine output of the first engine and the second engine remains about constant while a distribution of engine output between the first engine and the second engine changes, and wherein the consist maintains the constant traveling speed while the distribution of engine output between the first engine and the second engine changes.

17. A method, comprising:

adjusting a distribution of engine output between at least a first engine and a second engine in response to initiation of a regeneration mode, wherein the regeneration mode regenerates an exhaust gas recirculation (EGR) cooler that is coupled to the first engine.

18. The method of claim 17, wherein adjusting the distribution of engine output includes decreasing an engine output of the first engine and increasing an engine output of the second engine.

19. The method of claim 17, further comprising disabling or postponing initiation of the regeneration mode in response to a demand for combined engine power output of the first and second engines that is above a threshold engine power output value.

20. The method of claim 17, further comprising maintaining a combined output of the first engine and the second engine at an about constant level despite the distribution of engine output between the first engine and the second engine changing or being adjusted.

* * * * *